US006000779A

United States Patent [19]

Ng et al.

[11] Patent Number: 6,000,779

[45] Date of Patent: Dec. 14, 1999

[54] TRIPLE-CARTRIDGE INKJET SERVICE STATION

[75] Inventors: Keng Leong Ng; Eng Kuan Lim, both of Singapore, Singapore

[73] Assignee: Hewlett-Packard Company, Palo Alto, Calif.

[21] Appl. No.: 08/924,027

[22] Filed: Aug. 29, 1997

[51] Int. Cl.[6] ..... B41J 2/165

[52] U.S. Cl. ..... 347/24; 347/29; 347/33

[58] Field of Search ..... 347/24, 29, 30, 347/32, 33

[56] References Cited

U.S. PATENT DOCUMENTS

| | | | |
|---|---|---|---|
| 5,103,244 | 4/1992 | Gast et al. | 346/1.1 |
| 5,151,715 | 9/1992 | Ward et al. | 346/140 |
| 5,155,497 | 10/1992 | Martin et al. | 346/1.1 |
| 5,216,449 | 6/1993 | English | 346/140 |
| 5,252,993 | 10/1993 | Tomii et al. | 346/140 |
| 5,396,277 | 3/1995 | Gast et al. | 347/33 |
| 5,440,331 | 8/1995 | Grange | 347/32 |
| 5,455,609 | 10/1995 | Gast et al. | 347/32 |
| 5,559,538 | 9/1996 | Nguyen et al. | 347/32 |
| 5,587,729 | 12/1996 | Lee et al. | 347/32 |
| 5,635,965 | 6/1997 | Purwins et al. | 347/31 |
| 5,644,346 | 7/1997 | Schwiebert et al. | 347/33 |
| 5,714,991 | 2/1998 | Osborne et al. | 347/30 |
| 5,757,395 | 5/1998 | Chew et al. | 347/24 |
| 5,774,140 | 6/1998 | English | 347/33 |

OTHER PUBLICATIONS

Co–pending commonly–owned U.S. Patent Application S/N 08/566,221, entitled "Universal Cap for Different Style Inkjet Printheads", filed Nov. 30, 1995, U.S. Pat. No. 5,867, 184.

Co–pending commonly–owned U.S. Patent Application S/N 08/558,561, entitled "Dual Pivoting Wiper System for Inkjet Printheads", filed Oct. 31, 1995, U.S. Pat. No. 5,745,133.

Co–pending commonly–owned U.S. Patent Application S/N 08/533,136, entitled "Color Capable Single–Cartridge Inkjet Service Station", filed Sep. 25, 1995, U.S. Pat. No. 5,757, 395 in IDS as #1B.

*Primary Examiner*—N. Le
*Assistant Examiner*—Shih-Wen Hsieh
*Attorney, Agent, or Firm*—Flory L. Martin

[57] ABSTRACT

An indexing service station services interchangeable first and second inkjet cartridges when installed with a third inkjet cartridge in a dual-cartridge carriage of an inkjet printing mechanism. For printing graphics and text, the first cartridge usually prints black ink, while the third cartridge prints full-colorant concentrations of colored ink. For printing photographic type images, the black cartridge for printing text is replaced with the second cartridge which is an imaging cartridge. The imaging cartridge carries ink formulations having reduced colorant concentrations, which, when used in conjunction with the full color cartridge, provide near photographic image quality, as well as crisp black text and line art. The service station has three separate sets of servicing tools for independent servicing of the black, full color, and imaging cartridges. The full color servicing tools are mounted on a singular tumbler assembly, whereas both the black and imaging cartridge servicing tools; are mounted on a combination tumbler assembly, with both tumbler assemblies being driven by an indexing gear assembly. Leaf springs bias printhead wipers away from the tumbler assemblies, with translational and torsional spring flexure accommodating for any lack of parallelism between the printheads and their associated wipers. A method is also provided of servicing the black, full color, and imaging cartridges when installed in the printing mechanism.

17 Claims, 15 Drawing Sheets

100

120
129
128
127
123
118
124
122
119
126
125
115
112
116
250
167
166
114
104
116
106
110
156
144
134
154
165
156
132
152
160
155
140
138
130

FIG. 14
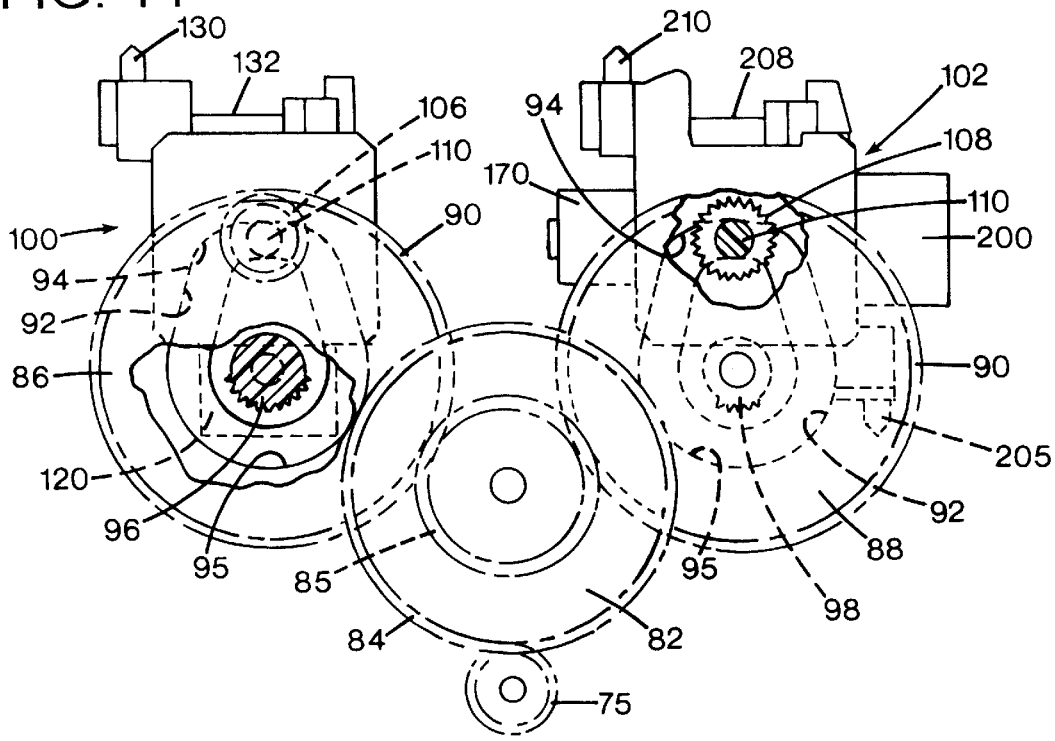
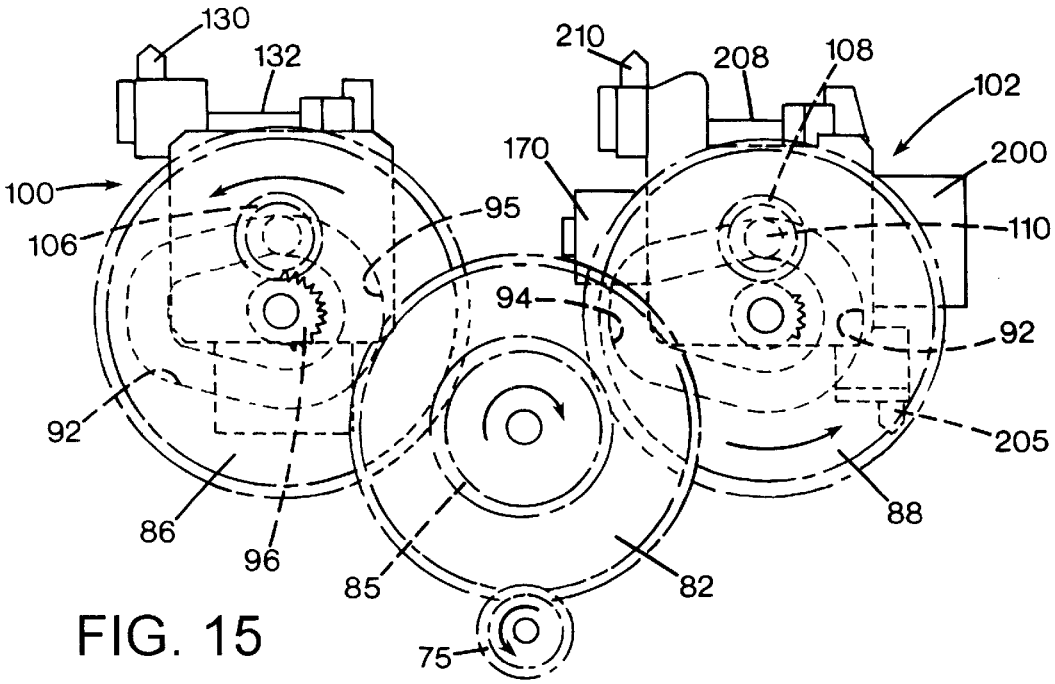
FIG. 15

FIG. 16
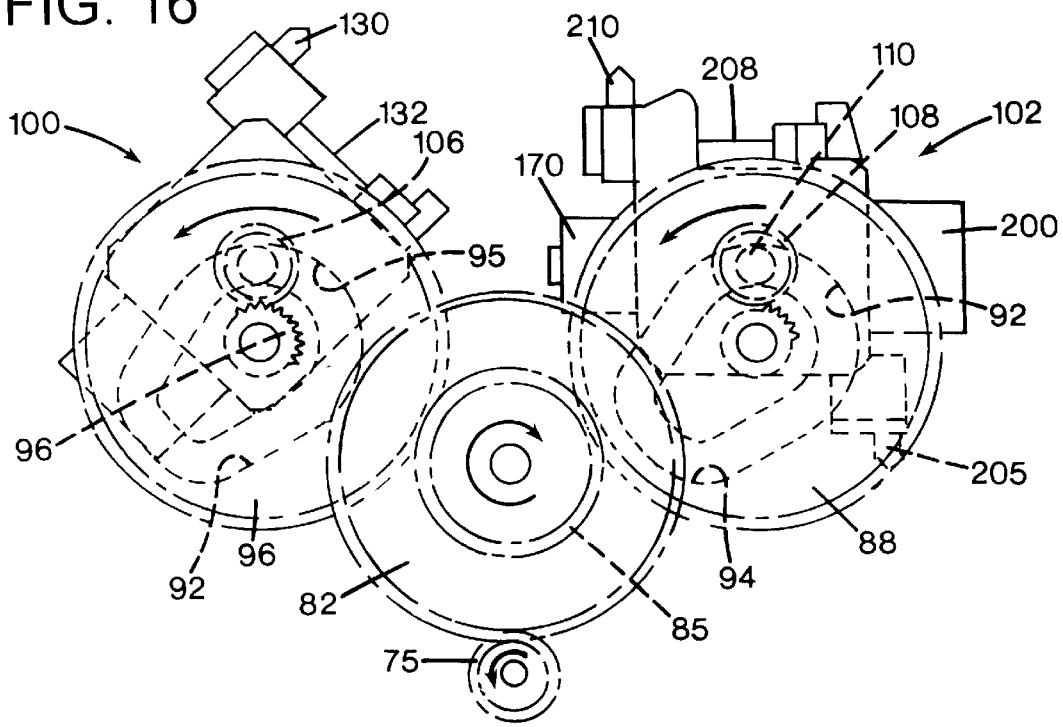
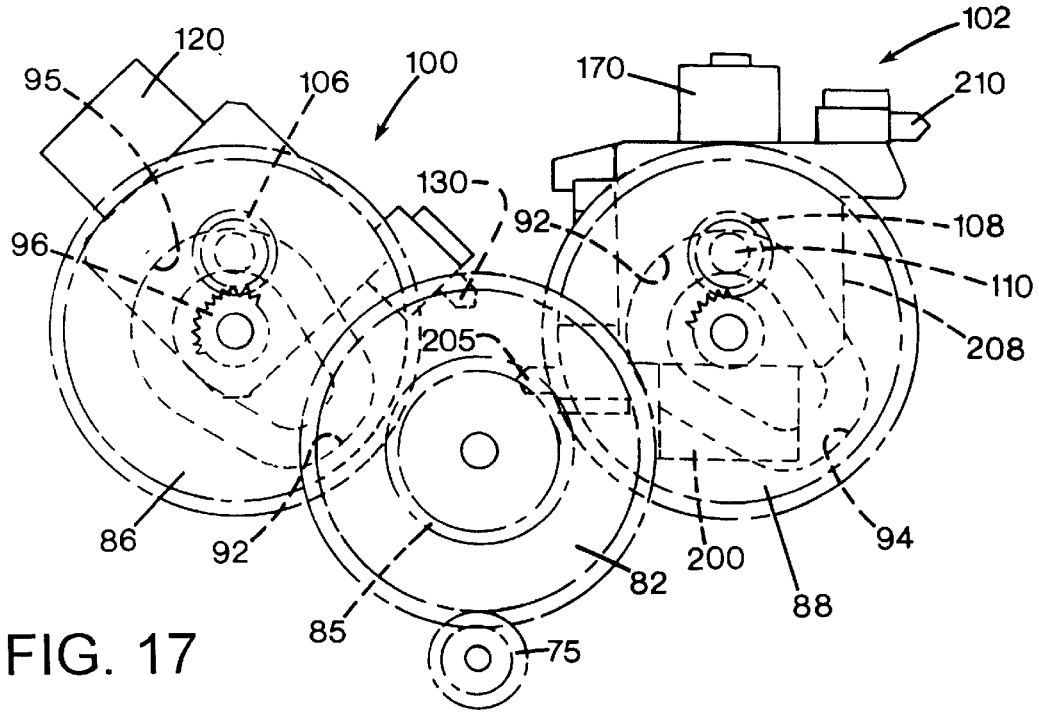
FIG. 17

FIG. 18
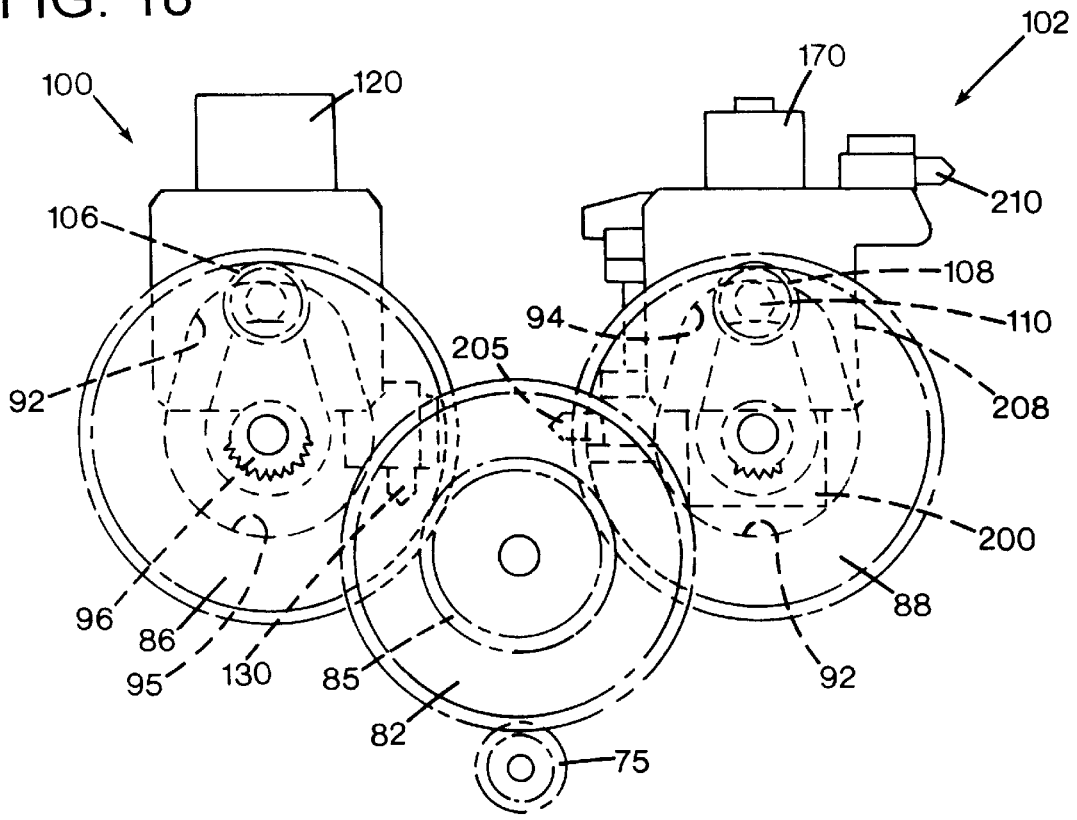
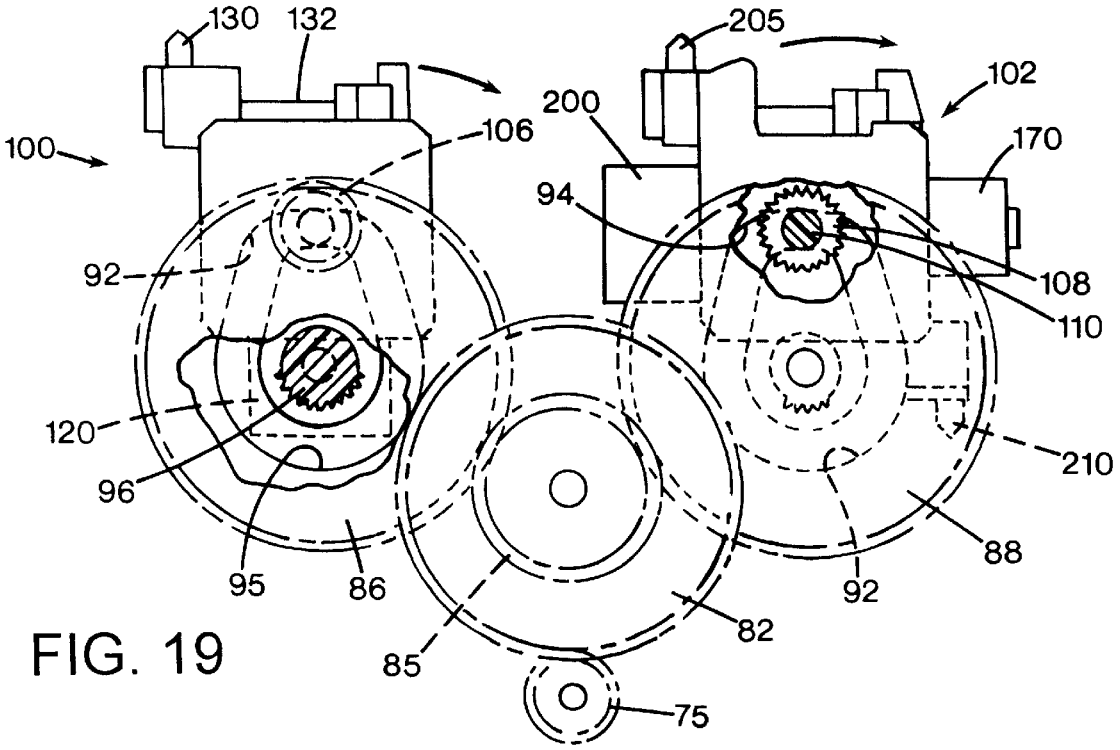
FIG. 19

TRIPLE-CARTRIDGE INKJET SERVICE STATION

FIELD OF THE INVENTION

The present invention relates generally to inkjet printing mechanisms, and more particularly to a service station for a triple-cartridge inkjet printing mechanism that receives a first inkjet cartridge and interchangeably receives one of at least two different types of inkjet cartridges, such as a black ink cartridge or a multi-color ink cartridge, each of which has different servicing needs.

BACKGROUND OF THE INVENTION

Inkjet printing mechanisms use cartridges or "pens" which shoot drops of liquid colorant, referred to generally herein as "ink," onto a page. Each pen has a printhead formed with very small nozzles or slits through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis. For storage, or during non-printing periods, service stations usually include a capping system which seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through (each of the nozzles in a process known as "spitting." Typically, the waste ink is collected in a stationary reservoir portion of the service station, which is often referred to as a "spittoon." After spitting, uncapping, or occasionally during printing, most service stations have an elastomeric wiper that wipes the printhead surface to remove ink residue, as well as any paper dust or other debris that has collected on the printhead.

Early inkjet printers used a single monochromatic pen, typically carrying black ink. Later generations of inkjet printing mechanisms used a black pen which was interchangeable with a tri-color pen, typically one carrying the colors of cyan, magenta and yellow within a single cartridge. The tri-color pen was capable of printing a "process" or "composite" black image, by depositing a drop of cyan, a drop of magenta, and a drop of yellow ink all at the same location. Two of these earlier single-pen, interchangeable inkjet printing mechanisms were sold by the Hewlett-Packard Company of Palo Alto, Calif., the present assignee, as the DeskJet® 310 portable inkjet printer and the DeskJet® 400 desktop inkjet printer. Unfortunately, images printed with the composite black usually had rough edges, and the overall image, even the color portions, often had a non-black hue or cast, depending for instance, upon the type of paper used.

The next generation of printers further enhanced the images by using a dual pen system. These dual pen printers provided a black pen along with a tri-color pen, both of which were mounted in a single carriage. These dual pen devices had the ability to print crisp, clear black text while providing full color images. One earlier dual pen inkjet printing mechanism was sold by the Hewlett-Packard Company of Palo Alto, Calif., the present assignee, as the DeskJet® 320 portable inkjet printer. As another answer to the dissatisfaction with the composite black images, a quad pen printing mechanism was developed which carried four cartridges in a single carriage. These quad pen printing mechanisms had a first pen carrying black ink, a second pen carrying cyan ink, a third pen carrying magenta ink, and a fourth pen carrying yellow ink.

Unfortunately, both the quad pen printers and the dual pen printers produced images, such as photographic images, which had a "grainy" appearance. For example, when printing a light colored portion of an image, such as a flesh tone, yellow dots were printed and lightly interspersed with magenta dots. When viewed at a distance, these magenta dots provided a flesh tone appearance; however, upon closer inspection the magenta dots were quite visible, giving the image an undesirable grainy appearance. This grainy appearance was similar to the graininess seen in newspaper photographs, or in photos taken using the wrong speed ("ASA" or "ISO" rating) of photographic film in low light conditions. Inkjet printing mechanisms are known as "binary drop devices" because they form images either by firing to place a drop of ink on the print medium, or by not firing. Not firing a droplet leaves either the print medium, or a previously printed drop(s), exposed to view. Unfortunately, such binary drop devices give inherently grainy images due to the visual "step" between the "drop on" and "drop off" regions. Worse yet, the larger the drops printed, the more grainy the resulting image appears, whether printing color or gray-scale images.

These earlier inkjet printers provided crisp black text and bright vivid graphics and charts, yet they failed to provide images of near photographic type quality, such as portrait, scenic landscapes, and other natural appearing images. Other devices have been used to provide high quality images, such as continuous tone devices some of which use a dye sublimation processes. Unfortunately, these continuous tone devices are expensive, and very unlikely to be viable within the small office and home printer markets, which currently sell printers to consumers within the price range of $200–$1,000 dollars.

Another printing, system, known as an "imaging" printing system, has been proposed. Using a basic dual pen printer platform, typically constructed for a monochrome (e.g. black) cartridge and a tri-color (e.g. cyan, magenta, yellow) cartridge, the monochrome cartridge is replaced with a tri-chamber "imaging cartridge." While the normally installed tri-color cartridge carries full colorant concentrations of inks, the imaging cartridge typically carries ink formulations having reduced colorant concentrations. For instance, the imaging cartridge may contain reduced colorant concentrations of cyan and magenta, and a full concentration of black ink. By interspersing droplets of reduced colorant concentration with droplets of the full colorant concentrations, the resulting images have a near photographic quality.

Unfortunately, in a dual pen inkjet printer, this ability to interchange the monochrome and multi-cartridges presents a unique set of problems when it comes to servicing of both types of cartridges. One earlier imaging inkjet printing mechanism was the model 693C DeskJet® inkjet printer sold by the Elewlett-Packard Company of Palo Alto, Calif., the present assignee. This system used dye-based color inks and a pigment-based back ink, which had different servicing needs than the dye-based color inks. In this earlier imaging system, a single, enlarged cap with multiple sealing lips was used to seal either the black pen or the imaging pen when installed. A single wiper was also used to service either the black pen or the imaging pen, with the wiper being of a more rigid upright profile, mounted on a spring-loaded arm to avoid excessive wiping forces which may otherwise damage the printhead. In transitioning to a completely dye-based ink imaging system, the fear of contamination between a dye-based black ink and reduced colorant concentrations of dye-based imaging inks lead to the rejection of a servicing system which used the same set of caps and wipers for both pens. Any contamination with back ink of the reduced dye loads of magenta, and particularly yellow, could seriously degrade the print quality of the resulting image. Thus, the service station for a dye.-based ink imaging system must accommodate the servicing needs of the monochrome black and imaging cartridges, without contaminating one pen with residue from the other pen.

SUMMARY OF THE INVENTION

According to one aspect of the present invention, a service station is provided for servicing the printheads of interchangeable first and second inkjet cartridges when installed with a third inkjet cartridge in a dual-cartridge carriage of an inkjet printing mechanism. The service station includes a frame and two tumbler assemblies. First, a combination tumbler assembly that supports first and second sets of servicing tools for servicing the respective first and second inkjet cartridges, and second, a singular tumbler assembly that supports a third set of servicing tools for servicing the third inkjet cartridge. The service station also has an indexing mechanism that pivotally and translationally couples the combination tumbler assembly and the singular tumbler assembly to the frame to index the third set of servicing tools into servicing positions to service the third cartridge printhead, and to either (1) index the first set of servicing tools into servicing positions to service the first cartridge printhead when installed in the carriage, or (2) index the second set of servicing tools into servicing positions to service the second cartridge printhead when installed in the carriage.

According to another aspect of the present invention, a method is provided for servicing the printheads of interchangeable first and second inkjet cartridges when installed with a third inkjet cartridge in a dual-cartridge carriage of an inkjet printing mechanism. The method includes the step of providing a combination tumbler assembly supporting first and second sets of servicing tools, and a singular tumbler assembly supporting a third set of servicing tools. In an indexing step, a selected tool of the third set of servicing tools is indexed into a pre-servicing position by moving the singular tumbler assembly, and (1) indexing a selected tool of the first set of servicing tools is indexed into a pre-servicing position by moving the combination tumbler assembly when the first cartridge printhead is installed in the carriage, or (2) indexing a selected tool of the second set of servicing tools is indexed into a pre-servicing position by moving the combination tumbler assembly when the second cartridge printhead is installed in the carriage. In moving step, the selected servicing tools are moved into servicing positions and thereafter, the printheads are serviced with these selected tools.

According to an additional aspect of the present invention, a service station is provided for servicing an inkjet printhead of an inkjet printing mechanism. The service station has a platform that is moveable to a servicing position. The service station also has an upright wiper supported by the platform to clean the printhead through relative movement of the printhead and the wiper when the platform is in the servicing position. A leaf spring member biases the upright wiper away from the platform, with the leaf spring member yielding translationally and torsionally to allow the wiper to accommodate for any lack of parallelism in the printhead encountered during cleaning.

According to a further aspect of the present invention, an inkjet printing mechanism is provided with a service station which may be as described above.

An overall goal of the present invention is to maintain cartridge health and provide a inkjet printing mechanism which prints sharp vivid images when using either a monochrome inkjet cartridge or a multi-color imaging inkjet cartridge in combination with a full color cartridge.

A further goal of the present invention is to provide a method of servicing different types of inkjet cartridges that are carrying dye-based inks, which may be interchangeably installed in an inkjet printing mechanism.

BRIEF DESCRIPTION OF THE DRAWINGS

FIGS. 13–20 are front elevational views of the drive gear mechanism of FIGS. 3 and 4, shown rotating the full color tumbler and the combination tumbler into their various servicing positions, specifically:

FIG. 13 shows the drive gears rotating to change the servicing tools;

FIG. 14 shows a full color wiper and a monochrome wiper raised into wiping positions;

FIG. 15 shows the full color wiper and the monochrome wiper retracted to allow the cartridges to pass thereover without wiping;

FIG. 16 shows a transition, following wiping of the full color printhead and the monochrome printhead, toward a capping position;

FIG. 17 shows the full color cap transitioning toward a retracted position, and the monochrome cap in a retracted position;

FIG. 18 shows the full color cap and the monochrome cap each fully raised into the capping position;

FIG. 19 shows the full color wiper and the imaging wiper each fully raised into the wiping position; and FIG. 20 shows the full color cap and the imaging cap each fully raised into the capping position.

DETAILED DESCRIPTION OF A PREFERRED EMBODIMENT

Figure 1:
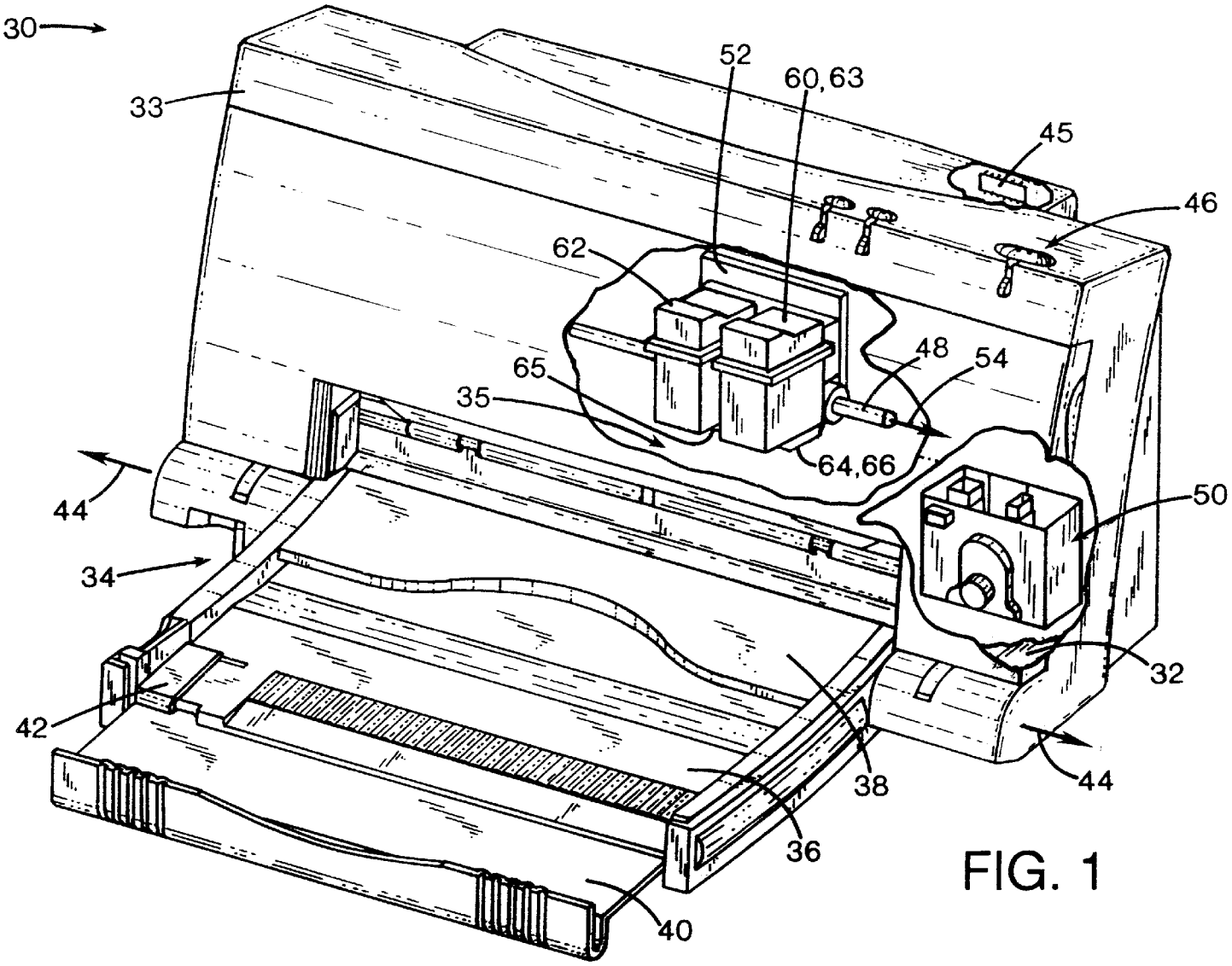
FIG. 1 is a partially cut away, perspective view of one form of an inkjet printing mechanism, here an inkjet printer, incorporating one form of the service station of the present invention.

FIG. 1 illustrates an embodiment of an inkjet printing mechanism, here shown as an inkjet printer 30, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 30.

While it is apparent that the printer components may vary from model to model, the typical inkjet printer 30 includes a chassis 32 which may be surrounded by a casing, housing or enclosure 33, preferably of a plastic material. The printer 30 also includes a print medium handling system 34 for supplying sheets of print media to the printer 30. Using a series of conventional motor-driven rollers (not shown), the media handling system 34 moves a sheet or page of print media through a printzone 35 from an input feed tray 36, inside the housing 23 for printing, then to an output tray 38. The print media may be any type of suitable sheet material, such as paper, card-stock, transparencies, mylar, foils, fabric, and the like, but for convenience, the illustrated embodiment is described using paper as the print medium. The media handling system 34 may include a series of adjustment mechanisms for accommodating different sizes of print media, including letter, legal, A-4, envelopes, etc., such as a sliding length adjustment portion 40 of the output tray 38, and a sliding width adjustment lever 42. In the illustrated embodiment, the output tray 38, 40 pivots around axis 44 to fold up against the exterior of the casing 33 for storage.

The printer 30 also has a printer controller, illustrated schematically as a microprocessor 45, that receives instructions from a host device, typically a computer, such as a personal computer (not shown). The printer controller 45 may also operate in response to user inputs provided through a key pad 46 located on the exterior of the casing 33. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 48 is supported by the printer chassis 32 to extend over the printzone 35 and a service station 50, which is also supported by the chassis 32. The guide rod 48 slideably supports a dual-cartridge carriage 52 for travel back and forth across the printzone 35 along a scanning axis 54. The carriage 52 is also propelled along guide rod 48 into a servicing region over the service station 50. A conventional carriage drive gear and DC motor assembly (not shown) may be coupled to drive an endless belt (not shown), secured to the carriage 52 in a conventional manner, to incrementally advance the carriage along guide rod 48 in response to rotation of the motor. The motor may operate in response to control signals received from the controller 45 to position the carriage 52 at selected locations over the print 2: one 35 and into a servicing region over the service station 50. To provide carriage positional feedback information to printer controller 45, an encoder strip (not shown) may extend along the length of the printzone 35 and over the service station 50, with a conventional optical encoder reader (not shown) mounted on the back surface of printhead carriage 52 to read positional information provided by the encoder strip. The manner of attaching the endless belt to the carriage 52, as well as the manner providing positional feedback information via the encoder strip reader, may be accomplished in a variety of different ways known to those skilled in the art.

Figure 2:
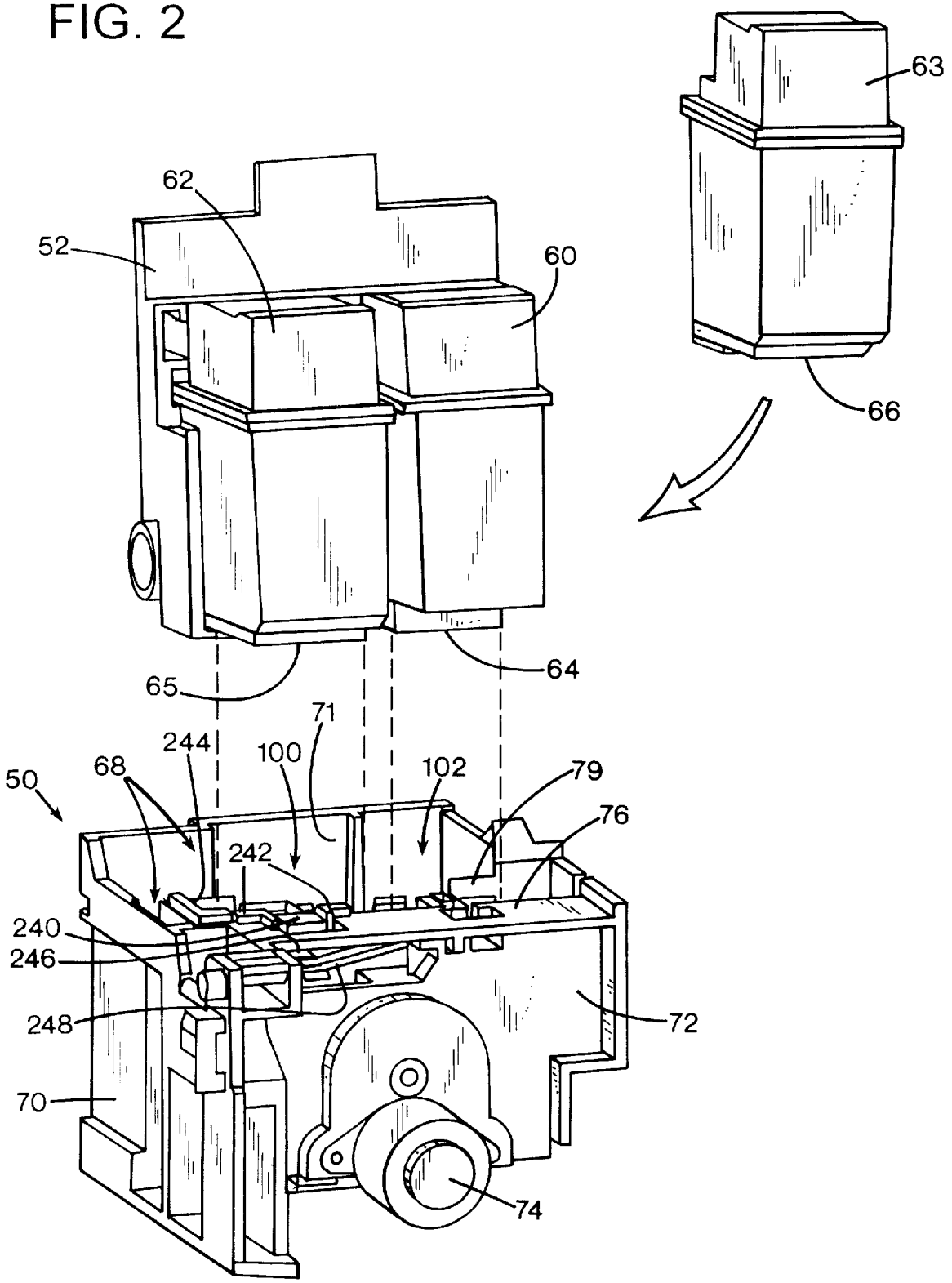
FIG. 2 is an enlarged, perspective view of portions of the inkjet printing mechanism of FIG. 1, in particular, a carriage having two inkjet cartridges installed therein, a third cartridge interchangeable with at least one of the installed cartridges, and a service station for servicing the three cartridges when installed in the carriage.

In the printzone 35, the media sheet receives ink from an inkjet cartridge, such as a single-chamber style monochrome, black ink cartridge 60, and/or a multi-chamber style, full color ink cartridge 62. As mentioned in the Background portion above, an imaging printing system has been proposed where the single-chamber black pen 60 is replaced with a multi-chamber imaging cartridge 63, as shown in FIG. 2. The imaging cartridge 63 illustrated herein has the same general construction as the full color pen 62, but instead may carry reduced colorant concentrations of ink, as described further below. These inkjet cartridges 60, 62 and 63 are also often called "pens" by those in the art. For the purposes of discussion, pen 60 is referred to herein as either the "monochrome pen" or the "black pen," pen 62 is called the "full color pen" referring to the full dye loads contained therein, and pen 63 is called the "imaging pen" because it may be used in conjunction with the full color pen 62 to print superior, near photographic quality images, such as portraits, landscapes, and the like.

The illustrated pens 60, 62 and 63 each include reservoirs or chambers for storing a supply of ink, and printheads 64, 65 and 66 respectively, for selectively ejecting the ink. The illustrated full color pen 62 is a multi-chamber pen having three reservoirs or chambers containing three dye-based ink colors, such as full colorant concentrations of cyan, yellow and magenta inks. The black ink pen 60 is illustrated herein as a single-chamber cartridge containing a dye-based ink. It is apparent that other types, of inks may also be used in the illustrated cartridges, such as pigment-based inks, paraffin-based inks, as well as hybrid or composite inks having both dye and pigment characteristics. While the black and color pens may be of different sizes, in the illustrated embodiment, the pens 60, 62 are of substantially the same size. The carriage 52 may be modified to interchangeably accommodate narrow and wider pens, for instance, by using the concepts disclosed in U.S. Pat. No. 5,208,610, assigned to the present assignee Hewlett-Packard Company.

Each printhead 64–66 has an orifice plate with a plurality of nozzles formed therethrough in a manner well known to those skilled in the art. The illustrated printheads 64–66 are thermal inkjet printheads, although other types of printheads may be used, such as piezoelectric printheads. The printheads 64–66 typically include a substrate layer having a plurality of resistors which are associated with the nozzles. Upon energizing a selected resistor, a bubble of gas is formed to eject a droplet of ink from the nozzle and onto the page in the printzone 35 to form a selected image. Ink may also be ejected into a spittoon portion 68 of the service station 50 during servicing, or to clear plugged nozzles. The printhead resistors are selectively energized in response to firing command control signals which may be delivered by a conventional multi-conductor strip (not shown) from the printer controller 45 to the print-head carriage 52.

As mentioned in the Background section, graininess was experienced in printing photographic type images with the earlier dual pen systems when using only a black pen 60 and a full color pen 62 which carries full colorant concentrations of cyan, yellow and magenta inks. To eliminate this graininess, an imaging printing system has been proposed where the single-chamber black pen 60 is replaced with the multi-chamber imaging cartridge 63, as shown in FIG. 2. The imaging pen 63 illustrated herein has the same general construction as the full color pen 62, but instead carries at least some reduced colorant concentrations of ink.

For instance, a reduced colorant concentration may be composed by maintaining the same amount of solvent or carrier for a given pen capacity while reducing the amount of dye in the concentration from that conventionally used for a full concentration. Reduced colorant concentrations of cyan and magenta are often preferred, rather than yellow because visually, yellow is a low contrast color, and any graininess of the yellow ink is not visually detectable to the human eye. Yet, in other embodiments, the third chamber may contain an ink formulation of either a reduced or full concentration of yellow colored ink, or a full or reduced concentration of black ink. For instance, a reduced yellow concentration may enhance transition regions in areas of flesh tones. However, use of the imaging cartridge 63 without yellow has been found to significantly enhance the visual appearance of light tones and mid-tones in photographic type images, particularly when compared to the earlier dual pen printers, which had only full colorant concentrations. Allowing replacement of an imaging cartridge 63 with the full colorant concentration of black ink in pen 60 is advantageous for printing clear, crisp black text, while a reduced colorant concentration black in the imaging cartridge provides better, photographic-type images.

Table 1 lists a variety of different interchangeable pen and ink formulation combinations, which may be implemented to provide a dual (or multiple) personality printer, capable of producing a variety of different types of output, each with outstanding print quality.

TABLE 1

Two Pen Carriage Ink Formulation Combinations

| | Interchangeable Carriage Position | | Other Position Third |
|---|---|---|---|
| Options | First Cartridge (Pen 60) | Second ("Imaging") Cartridge (Pen 63) | Cartridge (Pen 62) |
| Business | True Black | Partial C, M & Gray | Full C, M, Y |
| Imaging 1 | — | Partial C, M & True Black | Full C, M, Y |
| Imaging 2 | — | Partial C, M, Y | Full C, M, Y |
| Imaging 3 | — | Partial R, G, B | Full C, M, Y |
| Imaging 4 | — | Full R, G, B | Full C, M, Y |
| Imaging 5 | — | Gray | Full C, M, Y |

In Table 1, the following abbreviations are used: C for cyan, M for magenta, Y for yellow, R for red, G for green, and B for blue, with "full" indicating a full colorant concentration, and "partial" indicating a partial or reduced colorant concentration. "Gray" as used herein is considered to be a reduced colorant concentration of black colorant. The "first cartridge" corresponds to the single-chamber style monochrome pen 60, the "second cartridge" is the imaging cartridge 63 having the same multi-chamber construction as pen 62, and the "third cartridge" has the multi-chamber construction of the full color pen 62. The first and second cartridges are illustrated as being interchangeable, which leads to the problem (solved by the illustrated service station 50) of how to adequately service two different styles of inkjet cartridge printheads without contaminating one with ink residue remaining from the other.

For the printer 30 and controller 45 to distinguish whether the black pen 60 or the imaging pen 63 is installed in carriage 52, the pens may each have a unique identifier for automatic recognition by the controller 45, such as a distinct binary code and/or resistors of different resistances. These identifiers are decodeable by the software or firmware of the printer controller 45, and/or the software of a printer driver, located in a host computer or device which communicates with printer 30. One suitable identification scheme for interchangeable printheads is disclosed in U.S. Pat. No. 4,872,027, also assigned to the present assignee, Hewlett-Packard Company. Alternatively, an operator may indicate which cartridge is installed, by making an appropriate entry into a host computer or by merely pressing a button on the keypad 46. Upon communication of which pen is installed in carriage 52, the software driver within the host computer or printer then uses an appropriate rendering scheme suitable to which ever pen is installed. The printer controller 45 then employs suitable print modes and control parameters to generate firing signals to properly fire the installed cartridges 62, and either 60 or 63.

Triple-Cartridge Inkjet Servicing System

FIGS. 2–12 show one embodiment of the printhead service station 50 constructed in accordance with the present invention for servicing the single-chamber monochrome inkjet cartridge 60, and multi-chamber color inkjet cartridges, specifically the full color cartridge 62 and the imaging cartridge 63. The service station 50 includes a frame 70 which is supported by the printer chassis 32. The frame 70 is configured to define the spittoon 68, into which ink is ejected or "spit" to clear any clogs or blockages from the nozzles of printheads 64–66. The spittoon 68 may be constructed in a conventional manner, including a liner (not shown) of an absorbent material to absorb liquid ink residue. The service station 50 includes a rear wall portion 71 and a front wall portion 72. The front wall 72 supports a motor 74, such as a conventional stepper motor, that receives control signals from the printer controller 45.

Figure 3:
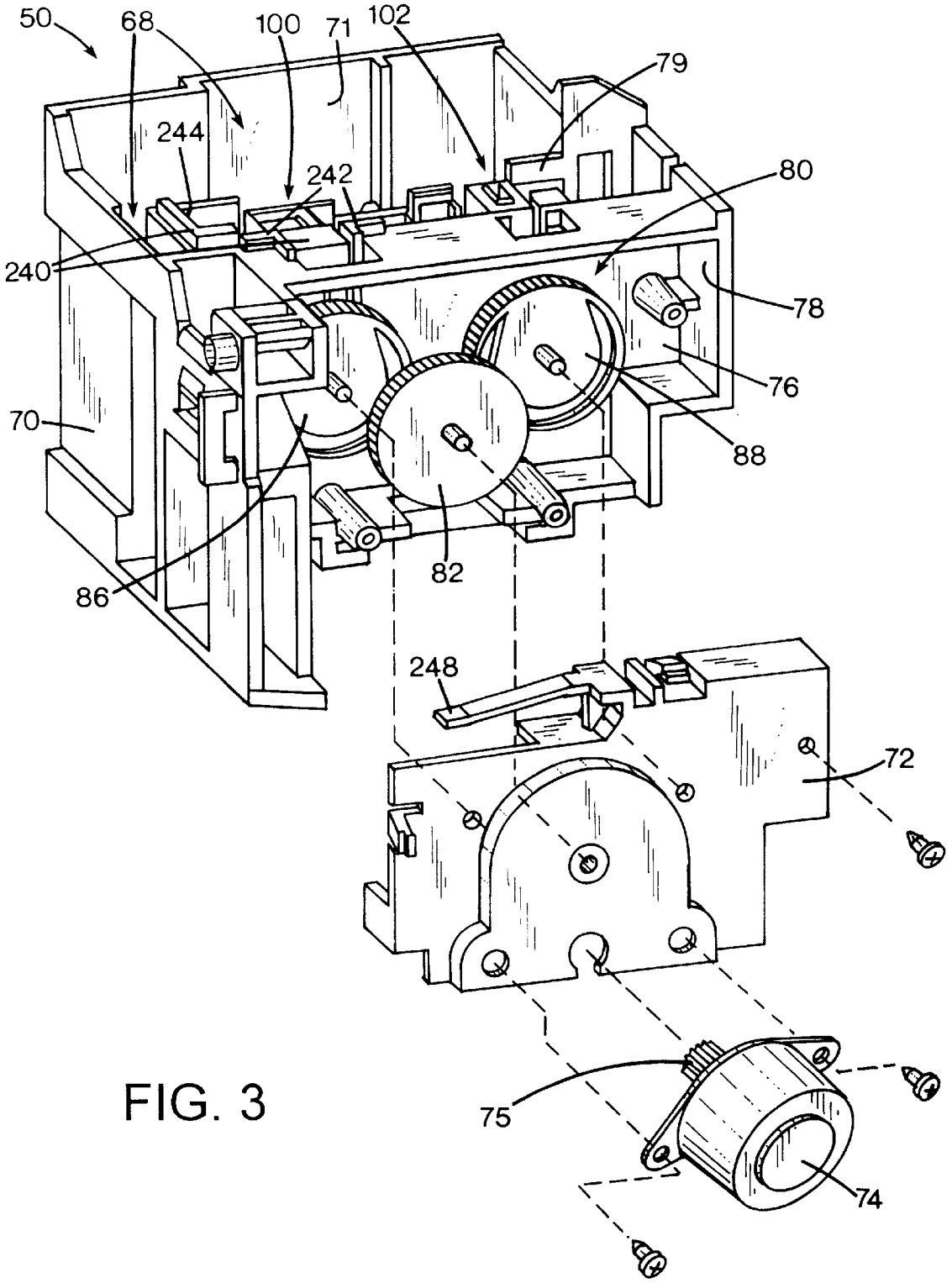
FIG. 3 is an exploded perspective view of the service station of FIG. 2, showing a motor and front wall thereof removed.
Figure 4:
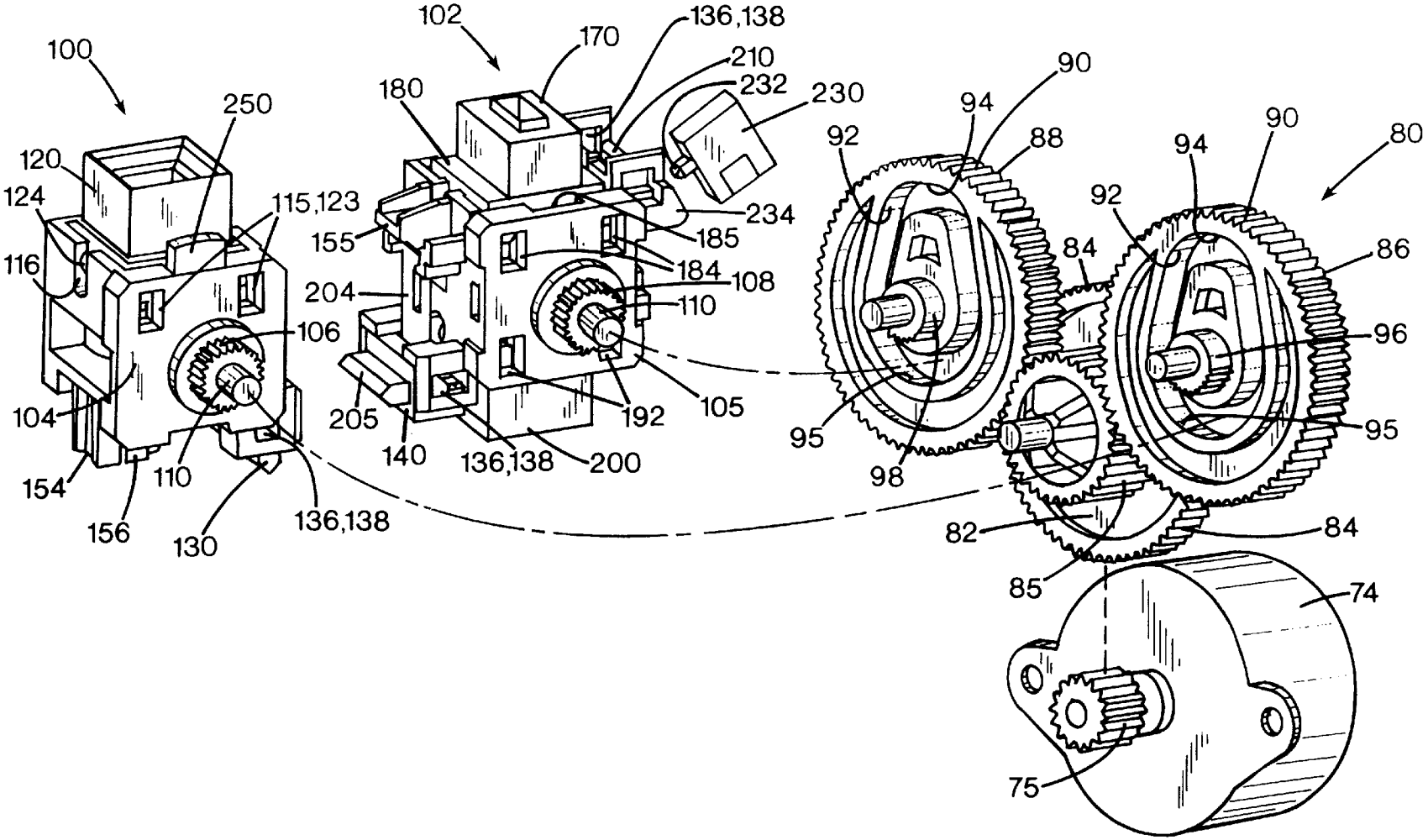
FIG. 4 is an exploded perspective view of portions of the service station of FIG. 2, specifically, the motor and a drive gear assembly, which together drive a full color cartridge tumbler assembly, and a combination monochrome and imaging cartridge tumbler assembly.

As shown in FIGS. 3 and 4, the motor 74 has an output shaft which supports a pinion drive gear 75. Screws or other fasteners may be used to attach the motor 74 to the front wall 72, and lo attach the front wall 72 to the service station frame 70. It is apparent that other mechanisms may be used to secure the motor 74 and front wall 72 to the frame 70, such as by bonding, other fasteners, and sliding or snap fits molded within the components. The service station frame 70 has an interior wall 76 spaced apart from the front wall 72 to define a drive gear receiving chamber 78. The service station frame 70 also has another interior wall 79 spaced apart from the rear wall 71 to define a reservoir portion of the spittoon 68, which may hold an absorbent liner as mentioned above.

The service station 50 has an indexing mechanism, such as a drive gear assembly 80, comprising a series of gears pivotally supported by bushings or bearing surfaces provided by the front wall 72 and the interior wall 76, as indicated by dashed lines in FIG. 3. The drive gear assembly 80 includes an intermediate reduction gear 82, which has a bull gear portion 84 driven by the motor pinion gear 75, and an output pinion gear 85. The intermediate pinion gear 85 drives a color gear 86 for servicing the full color pen 62, and a combination gear 88 for servicing the black pen 60 or the imaging pen 63, depending upon which pen 60 or 63 is installed within carriage 52.

Several of the components of the color drive gear 86 and the combination drive gear 88 are the same. For instance, gears 86 and 88 each have a bull gear 90 which is driven by the output pinion 85 of the intermediate gear 82. Furthermore, each gear 86, 88 includes a cam track 92, which has a tumbler elevator segment 94, and a tumbler rotating segment 95. Each of the drive gears 86, 88 includes a partially-toothed pinion output gear, but here, gears 86 and 88 differ. The color drive gear 86 has an output pinion gear 96 which has teeth around approximately a 180° segment, so only half of the full color pinion gear 96 has teeth. In contrast, the combination gear 88 has an output pinion gear 98 which has teeth only along a 90° arc of the output gear, so only one-quarter of the combination pinion gear 98 has teeth. The reason for the different teeth on gears 96 and 98 promotes servicing of the color printhead 65, and whichever of the black or imaging printheads 64, 66 are installed in carriage 52, as described in greater detail below with respect to FIGS. 12–18.

Figure 5:
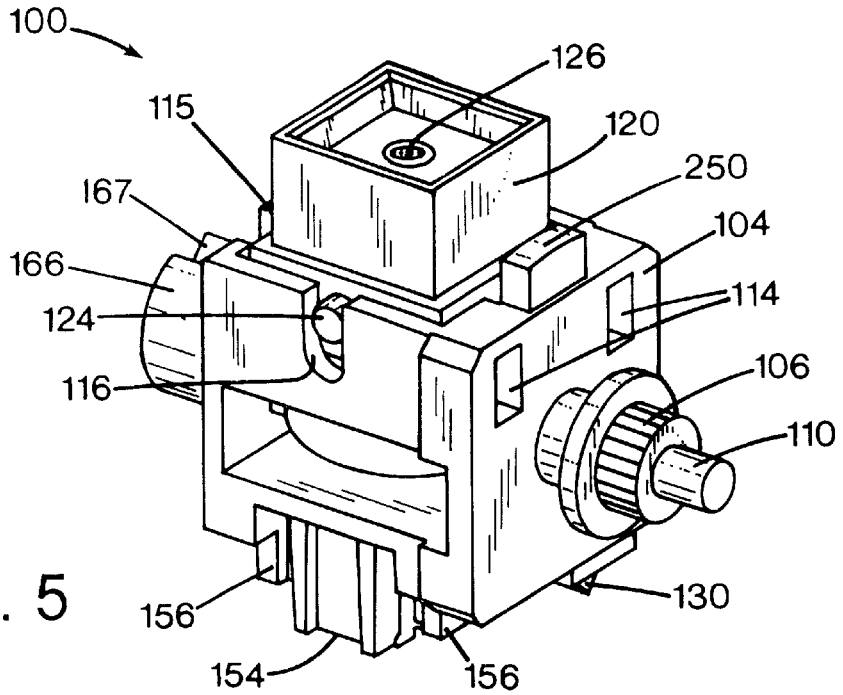
FIG. 5 is a perspective view of the full color tumbler assembly of FIG. 4.
Figure 6:
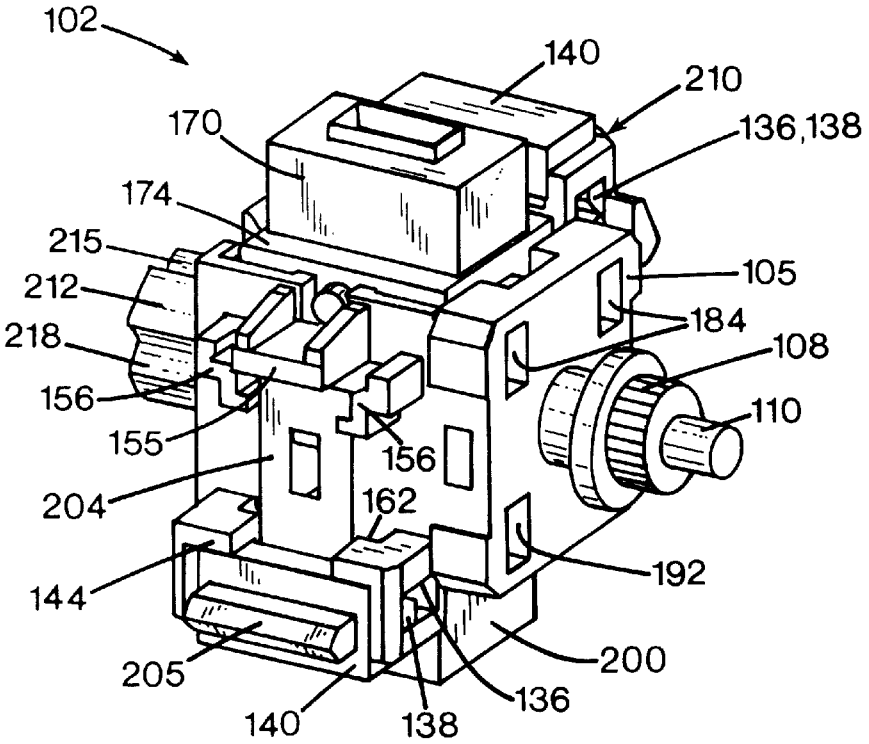
FIG. 6 is a perspective view of the combination tumbler assembly of FIG. 4.

As shown in FIGS. 4–6, the service station 50 also has a singular, color tumbler assembly 100 (FIG. 5) and a combination tumbler assembly 102 (FIG. 6), which respectively service the color printhead 65, and whichever of the black or imaging printheads 64, 66 are installed in carriage 52. The color and combination tumbler assemblies 100, 102 each include a tumbler frame or body 104, 105, respectively, which are, for the most part, lodged between the two interior walls 72 and 79. The tumbler assemblies 100 and 102 each have an input or bull gear 106 and 108, respectively, which extends outwardly from the respective tumbler bodies 104, 105. The tumbler assemblies 100, 102 both have a cam follower spindle 110, with spindle 110 of the color tumbler 100 riding in cam track 92 of the color drive gear 86, and spindle 110 of the combination tumbler 102 riding in the cam track 92 of the combination drive gear 88. The bull gears 106, 108 and the spindles 110 engage the indexing mechanism drive gear assembly 80, allowing assembly 80 to pivotally and translationally couple the combination tumbler assembly 102 and the color, singular tumbler assembly 100 to the frame 70 to selectively index servicing tools into servicing positions to service the printheads 65, and either 64 or 66.

When the cam follower 110 of the color tumbler 100 rides in the cam track rotating portion 95, the teeth of the bull gear 106 engage the 180° arc of teeth on pinion gear 96 of the color drive gear 86. Similarly, when the cam follower 110 of the combination tumbler 102 rides within the cam track rotating portion 95 on the combination gear 88, the teeth of the tumbler bull gear 108 are engaged with the 90° arc of teeth on pinion gear 98. Thus, during this engagement of teeth 106 and 96, the color tumbler 120 is rotated 180° (one half revolution), whereas engagement of teeth 108 and 98 causes the combination tumbler to rotate 90° (one quarter revolution). Elevation of the color and combination tumbler assemblies 100, 102 into their servicing positions, and their descent or lowering into printing or rest positions, is accomplished through travel of the spindles 110 within cam tracks 92 of drive gears 86 and 88. Elevation to a servicing position is accomplished when the spindles 110 move to the upper crest of the cam track elevator portion 94, whereas lowering of the tumblers 100, 102 occurs when the spindles 110 move away from the crest of the elevator 94 and toward the cam track rotating portion 95.

Figure 7:
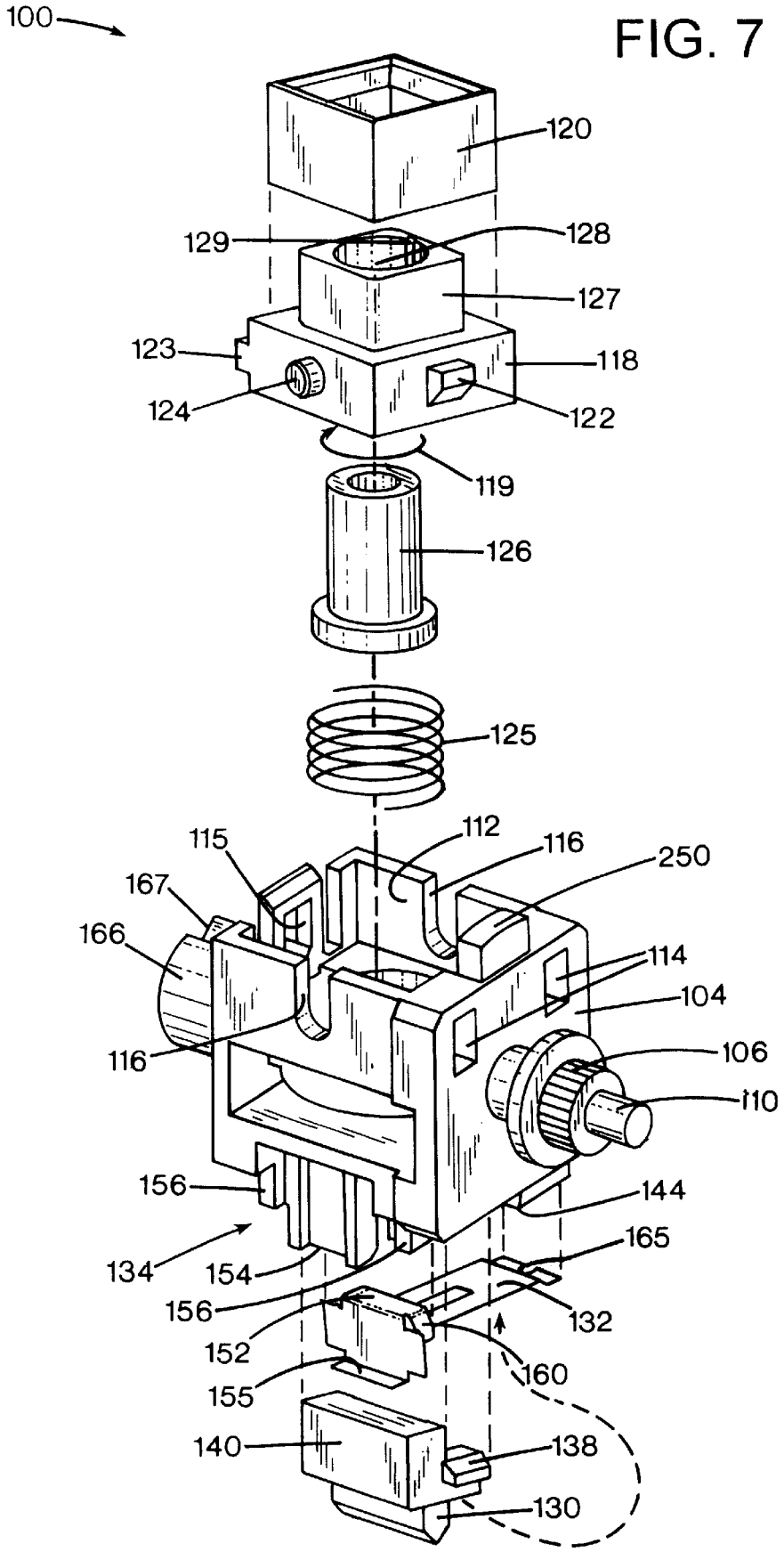
FIG. 7 is an exploded perspective view of the full color tumbler assembly of FIG. 5.

The color tumbler assembly 100 is shown in greater detail in FIG. 7 as including a color tumbler body 104 that supports servicing tools for servicing the color printhead 65. The color tumbler body 104 defines a cap mounting pocket 112. To secure the cap components within pocket 102, the color tumbler body 104 defines a pair of runner guide slots 114 through a front wall, from which the bull gear 106 and cam spindle 110 extend. Defined by a rear wall of the tumbler body 104, opposite the guide slots 114, is a single flexible runner guide member 115 defining a guide slot therethrough. The guide member 115 has a beveled upper surface to facilitate a snap fit of the cap components, as described further below. Perpendicular to the runner guide slots 114, 115 are a pair of U-shaped guide slots 116, defined by opposing side walls of tumbler body 104.

The tumbler assembly 100 includes a cap base 118 which supports an elastomeric cap 120. The cap base 118 includes a beveled runner member 122 extending from a front wall, and a pair of rectangular runner members, such as runner 123, extending from a rear wall of the base 118. To show the beveled nature of runner 122 in the view of FIG. 7, the rear wall is facing toward the right, so for assembly the cap base 118 is actually rotated 180° in a horizontal plane, as indicated by the curved arrow 119, from the position shown in FIG. 7. The pair of runner members 123 slide vertically within the pair of runner guides 114 of the tumbler body 104 when assembled. During assembly, the runners 123 are partially inserted into slots 114, and the beveled lower portion of runner 122 is pushed into contact with the beveled upper surface of runner guide member 115. Further downward pressure momentarily flexes the guide member 115 outwardly to facilitate a snap fit as the base runner 112 slips into the slot portion of guide 115.

The guide channels 114, 115 serve to secure the base 118 within the mounting pocket 112, as well as to provide for aligned vertical movement of the cap 120 with respect to the tumbler body 104. To allow the cap 120 to tilt or gimbal during capping, the base 118 includes a pair of pivot posts, such as post 124, which are received within the opposing U-shaped slots 116 of the tumbler body 104. The runners 122 and guide channels 114, 155, together with the U-shaped slots 116 and pivot posts 124, cooperate to allow the cap base 118 to move translationally into the interior of the mounting pocket 112, while also pivoting or gimbaling to tilt cap 120 to seal an imperfectly seated or manufactured printhead 65. Thus, the gimbaling action provided by posts 124 and slots 116 compensates for any lack of parallelism between the printhead 65 and the lips of cap 120.

To bias the sealing lips of cap 120 toward the full color printhead 65, a biasing member, such as a coil spring 125, rests within a lower portion of the mounting pocket 112. The biasing spring 125 pushes upwardly against the lower surface of the cap base 118. Preferably, the spring 125 is sized to surround a flange portion of a vent cup or plug 126, with the other end of spring 125 seated within a cylindrical recess defined by the color tumbler body 104.

The cap base 118 has an upwardly extending neck portion 127 which defines a throat 128 that extends through to a recessed undersurface of the base 118. The cap 120 is seated down and around the neck portion 127. When assembled, the vent plug 126 is seated inside the recessed portion of the base 118, resting in contact with the undersurface of the base 118 and surrounding the lower opening of the throat 128. A sealing chamber is formed when the lips of cap 120 contact the full color printhead 65 during capping, with this chamer being defined by the printhead 65, the lips of cap 120, the interiors of the throat 128 and the vent plug 126.

To relieve any pressure build-up of air within the interior of the sealing chamber upon capping, air is vented to atmosphere through a vent channel or groove 129 defined along the interior of the surface of the throat 128. The vent groove 129 extends along the entire length of the throat, and continues along the recessed undersurface of the base 118 until exiting past the exterior of the lower flange portion of the vent plug 126. Preferably, the cap 120 is formed of an resilient, non-abrasive, elastomeric material, such as nitrile rubber, ethylene polypropylene diene monomer (EPDM), or other comparable materials known in the art. The vent plug 126 is preferably of an elastomeric material, which preferably yields during capping and barometric pressure changes to prevent depriming of the printhead 65, such as a Santoprene® rubber material sold by the Monsanto Company, Inc., or any other ink-phyllic resilient compound structurally equivalent thereto, as known to those skilled in the art.

Figure 9:
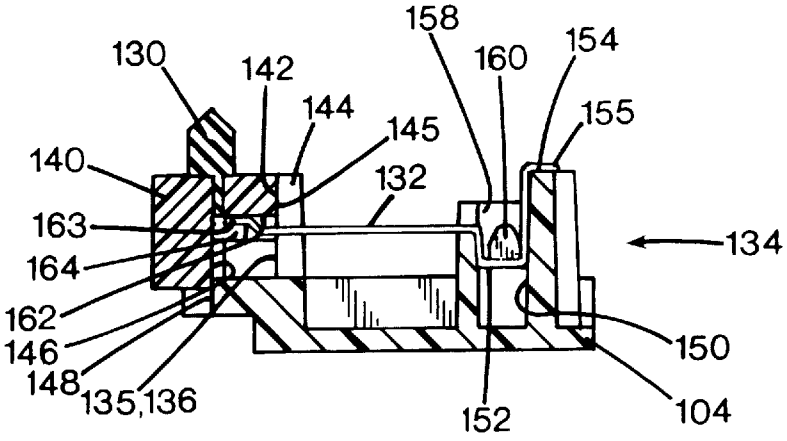
FIG. 9 is an enlarged, cross-sectional view taken along lines 10—10 of FIG. 9, illustrating one manner of biasing the wipers toward a cartridge printhead.
Figure 8:
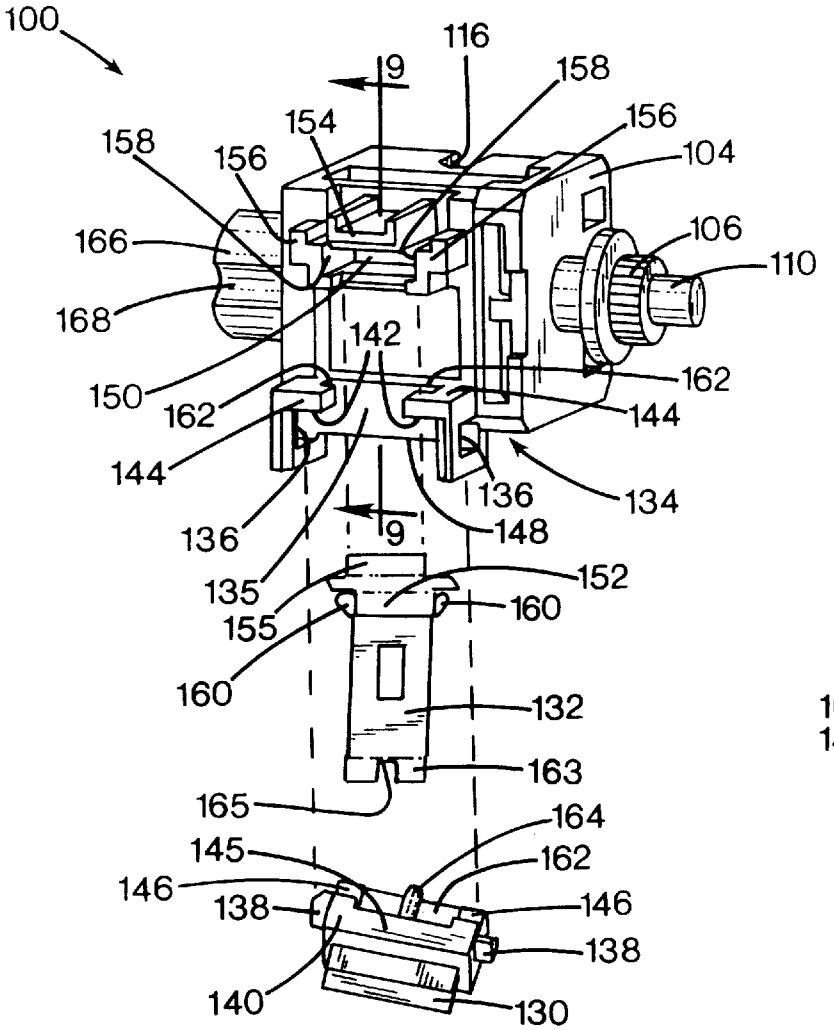
FIG. 8 is an exploded perspective view of the wiper assembly of the full color tumbler of FIG. 5, which also may be used for the monochrome and imaging wipers on the combination tumbler assembly of FIG. 6.

The wiping portion of the full color tumbler assembly 100 is shown in FIGS. 7–9 as including a color wiper 130, which may be of an elastomeric material, EPDM, such as that described for cap 120. Preferably, the durometer of the elastomeric wiper 130 is selected in the Shore A range of 40–100, with a more preferred range being between 85–95, with a preferred nominal value being about 90, plus or minus a standard tolerance, such as +/−5. The cross-section of the wiper blade 130 has a peaked shape, with a knife blade-like wiping edge, which is more rigid than earlier flexible elastomeric wiper blades. To prevent damage of the color printhead 65 during wiping, the wiper 130 is mounted with a biasing member, such as a leaf spring 132, to a wiper mounting portion 134 of the tumbler body 104. As best shown in FIG. 8, the wiper mount 134 includes a wiper mounting pocket 135 which is flanked on each side by a pair of runner guide slots 136 defined by the mount 134. A pair of opposing runner ears 138 extend outwardly from each side of a wiper base 140, which supports the elastomeric wiper 130. The runner ears 138 are slideably received within the guide slots 136 to allow motion of the wiper 130 toward and away from the tumbler body 104. Note that in the view of FIG. 7, the wiper 130 and base 140 are shown in the exploded view as being rotated 180° from their assembled orientation, as indicated by the curved dashed line, to display the right side thereof, whereas FIG. 8 shows the proper orientation for the wiper and base with respect to the tumbler body 104. When assembled, rotation of the wiper 130 with respect to the tumbler base 104 is prevented by a pair of interior surfaces 142 of wall 144, which in part defines the wiper pocket 135, contacting a surface 145 of the wiper base 140, and by the abutment of a pair of surfaces 146 of the wiper base against surface 148 of the wiper mount 134.

The wiper mount 134 of the tumbler body 104 also has a spring mounting pocket 150 that receives a U-shaped bend portion 152 of the leaf spring 132, as shown in FIG. 8. The wiper mount 134 also has an upright support ledge 154, upon which rests an end tab portion 155 of the leaf spring 132. The wiper mount 134 also has a pair of walls 156 extending from body 104 and bounding the wiper mounting chamber 135 adjacent the support ledge 154. Two opposing interior surfaces 158 of walls 156 serve as gripping surfaces into which a pair of opposing spring loaded barbs 160 resiliently grip to secure the leaf spring 132 between walls 156. The spring loaded barbs 160 extend outwardly from the U-shaped portion 152 of the leaf spring 132 to secure the spring 132 in the spring receiving pocket 150. From the spring mounting pocket 150, the leaf spring 132 extends across the tumbler body 104, between the pair of walls 144, and into the wiper mounting chamber 135. The wiper base 140 has an undersurface 162 which is biased away from the tumbler body 104 by a wiper engaging end 163 of spring 132 to urge the wiper 130 toward the printhead 65.

To maintain alignment of the wiper 130 in a direction perpendicular to the scanning axis 54 (FIG. 1), so the wiper 130 contacts the nozzles at each end of the linear nozzle arrays of the color printhead 65, the wiper base 140 has an alignment ridge 164 projecting from the undersurface 162. The wiper engaging end 163 of spring 132 defines an alignment notch 165 which is sized to surround the alignment ridge 164 of the wiper base 140. The alignment ridge 164 and notch 165 cooperate to preferably center the base 140 between the two opposing walls of the wiper mount 134 that define slots 136 therethrough.

Thus, the wiper engaging end 163 of spring 132 pushes upon the lower surface 162 of the wiper base 140, which is captured by the ear runners 138 residing within the runner guides 136 of the tumbler body 104. The guides 136 allow the wiper base 140 to move downwardly toward the tumbler body 104, flexing the leaf spring 132 through contact with spring end 163. The leaf spring 132 may flex downwardly as well as torsionally to allow the wiper blade 130 to accommodate for any lack of parallelism between the knife blade wiping edge of wiper 130 and the printhead 65. During any torsional flexure of spring 132, the alignment ridge 164 and notch 165 prevent the wiper base 140 from sliding along the spring end 163 and possibly missing some nozzles during a wiping stroke. Advantageously, by selecting the thickness, length and width of the leaf spring 132, a desired wiping force may be applied to wiper 130 while avoiding excessive wiping forces that could otherwise damage the printhead 65.

Opposite the cam spindle 110 and drive gear 106, the tumbler body 104 has a rear support hub 166 extending therefrom. The support hub 166 has two notches formed therein, described further below with respect to FIG. 11. One notch is a wiper notch 167, viewable in FIG. 7, and the other is a capping notch 168, viewable in FIG. 8.

Figure 10:
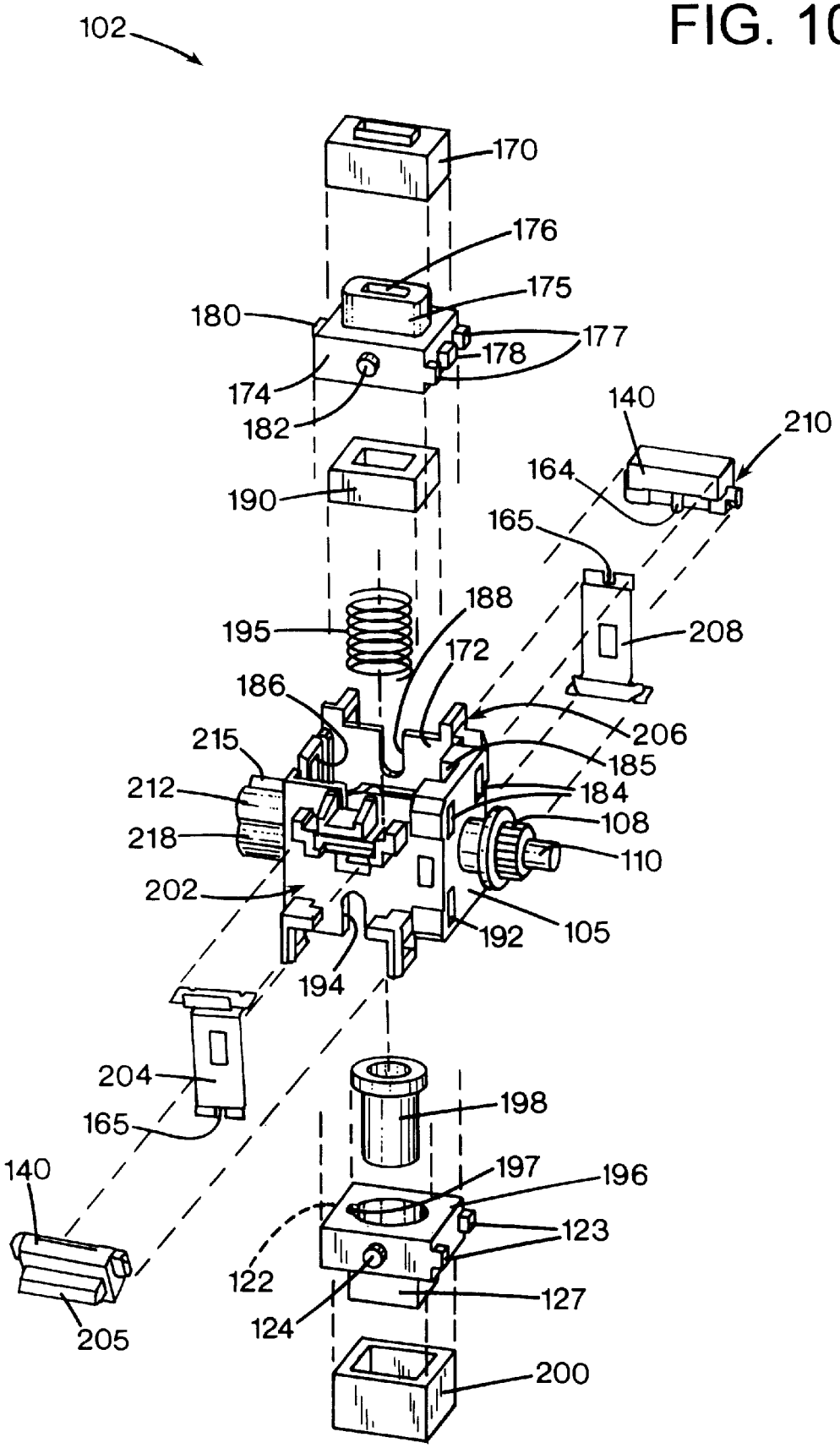
FIG. 10 is an exploded perspective view of the combination tumbler assembly of FIG. 6.

The construction of the combination tumbler assembly 102 is described with respect to FIGS. 6 and 10. The combination tumbler assembly 102 includes a black cap 170 which secured within an upper portion of a through-sleeve member 172 defined by the combination tumbler body 105. The tumbler assembly 102 includes a black cap base 174 having an upwardly projecting neck 175 with a throat 176 extending therethrough. The black cap 170 is seated over the neck 175. The cap base 174 has three runner ears projecting from one side thereof, specifically, a pair of outside ears 177 and a central ear 178 located therebetween. On the side of base 174 opposite ears 177, 178 is a single beveled runner ear 180, which is preferably similar in construction to the runner 122 on the color base 118 shown in FIG. 7. The black base 174 also includes a pair of pivot posts each located on opposing sides, such as pivot post 182, which performs the same function as pivot post 124 on the color base in FIG. 7.

To receive the cap base 174, the body 105 surrounding sleeve 172 defines a pair of runner guide slot,; 184 extending through a front wall of the tumbler body 105 from which the cam spindle 110 and bull gear 108 extend. The slots 184 slideably receive the runner ears 177 of the cap base 174. The tumbler body 105 also defines a vertical slot 185 which slideably receives the central runner 178 of the cap base 174. The tumbler body 105 also defines another runner guide member 186 located along a rear wall of the body 105 opposing runner guides 184, 185. The runner guide member 186 has a slot therethrough. The guide 186 also has a beveled upper surface, which allows for a snap fit of with the cap base runner 180 upon assembly, in the same manner as described above for assembling the color cap base 118 into receiving pocket 172 of FIG. 7. The tumbler body 105 also defines a pair of opposing U-shaped slots, such as slot 188, which slideably and pivotally receive the pair of pivot posts 182 on the cap base 174.

The final component of the black cap assembly portion of the combination tumbler assembly 102 is a vent cup or plug 190, which is received within a hollow interior portion of the cap base 174. A vent channel or groove, formed in the surface of the interior walls of the cap base 174, extends from the throat 176 to the bottom of the base 174 to define a vent path when the sealing lips of cap 170 engage the black printhead 64. This; vent passageway, defined between the vent groove and the vent plug 190, allows air to escape from the sealing chamber defined by these components when the printhead 64 is sealed, to prevent depriming of the printhead nozzles during the capping process.

The end of the through sleeve 172 opposite the black cap mounting portion comprises an imaging cap mounting portion which is bordered by a pair of guide slots, such as guide slot 192, defined by tumbler body 105 to extend through the front wall of the body. The tumbler body 105 also defines another beveled runner guide member (not shown in FIG. 10) located along the rear wall of the body 105, opposing runner guides 184, 185. The runner guide member 186 has a slot therethrough, and a beveled upper surface, which are of substantially the same construction as guide members 186 and 115 (FIG. 7) to provide a snap fit of the cap components upon assembly. The imaging cap mounting portion along the lower surface of sleeve 172, as shown in the view of FIG. 10, is also bounded by a pair of opposing U-shaped slots, such as slot 194.

Sandwiched in a central portion of the sleeve 172 is a biasing member, such as coil spring 195. The guide slots 192 and the U-shaped slots 194, as well as the snap fit guide (not seen in a view of FIG. 10, but of similar construction to guides 186 and 115) are configured to receive an imaging base 196, which may be of substantially the same construction as base 118 shown in FIG. 7, with components similarly numbered. Ore advantage of the view of the cap base 196 in FIG. 10, is that a vent channel groove 197, formed in the surface wall of the hollow interior of the base 196, may be viewed. The vent channel 197 of the imaging cap base 196 is similar to the vent channel of the full color cap base 118. Upon assembly within this hollow interior a vest cup or plug 198 cooperates with the vent channel 197 to define a vent passageway which prevents depriming of the imaging printhead 66 during capping. The imaging vent plug 198 may be of substantially the same construction and materials as described for the full color vent plug 126 of FIG. 7.

An imaging cap 200 surrounds the neck portion 127 of the cap base 196, with the imaging cap 200 having sealing lips used to cap the printhead 66 of the imaging cartridge 63. The cap 200, base 196 and vent plug 198 function as described above for the color cap 120, base 118 and plug 126 of FIG. 7, to define a vent path to prevent depriming of the nozzles on the imaging printhead 66 during the capping process. Upon assembly, the runners 123 and 122 of base 196 are inserted within the runner guides, such as guide 192 and the opposing snap fit guide (not shown). The pivot posts 124 reside within the U-shaped slots 194 of the tumbler body 105 to provide the same gimbaling action as described above for the color and black caps 120 and 170, to accommodate for any lack of parallelism of the cap lips with respect to the imaging printhead 66.

When assembled, the biasing spring 195 provides an upward capping force on the black cap 170 by pressing against the vent plug 190 and base 174, while also providing a biasing force for the imaging cap 200 by pressing against vent plug 198 and base 196 when the imaging printhead 66 is sealed. This construction of two opposing caps residing within a single tumbler sleeve biased for capping force by a single spring is similar to the service station design used in the DeskJet® 400 model inkjet printer, sold by the Hewlett-Packard Company, the present assignee, which is a single pen device, capable of receiving a color or a monochrome (e.g. black) pen.

The tumbler body 105 also defines an imaging wiper mounting surface 202, which is preferably of similar construction to that defined at length above for the color wiper mounting surface 134 of FIG. 8. The combination tumbler assembly 102 also includes an imaging wiper biasing spring 204, which is preferably of the same construction as described above for the color wiper spring 132. The combination tumbler assembly 102 also has an imaging wiper 205, which may be of similar construction and materials as described for wiper 130, and mounted to a similar base unit 140. The manner of assembling the leaf spring 204 and wiper 205 to the tumbler body 105 may be as described above with respect to FIGS. 8 and 9 for spring 132 and wiper 130. Similarly, on the side opposing the imaging wiper mount 202, the tumbler body 105 defines a black wiper mounting surface 206, which is also preferably constructed as described above for the color wiper mounting surface 134 in FIG. 8. Similarly, a black wiper spring 208 is used to mount a black wiper 210 having a base 140, to the mounting surface 206, in the same manner described above for mounting wiper 130 and spring 132 to surface 134 in FIGS. 8 and 9. Thus, by using the same mounting structure 134, 202, 206 and the same construction for springs 132, 204, 208, as well as for the bases 140 of wipers 130, 205 and 210, the number of different parts for service station 50 is decreased, providing economies in component procurement, as well as in assembling efficiency.

Figure 11:
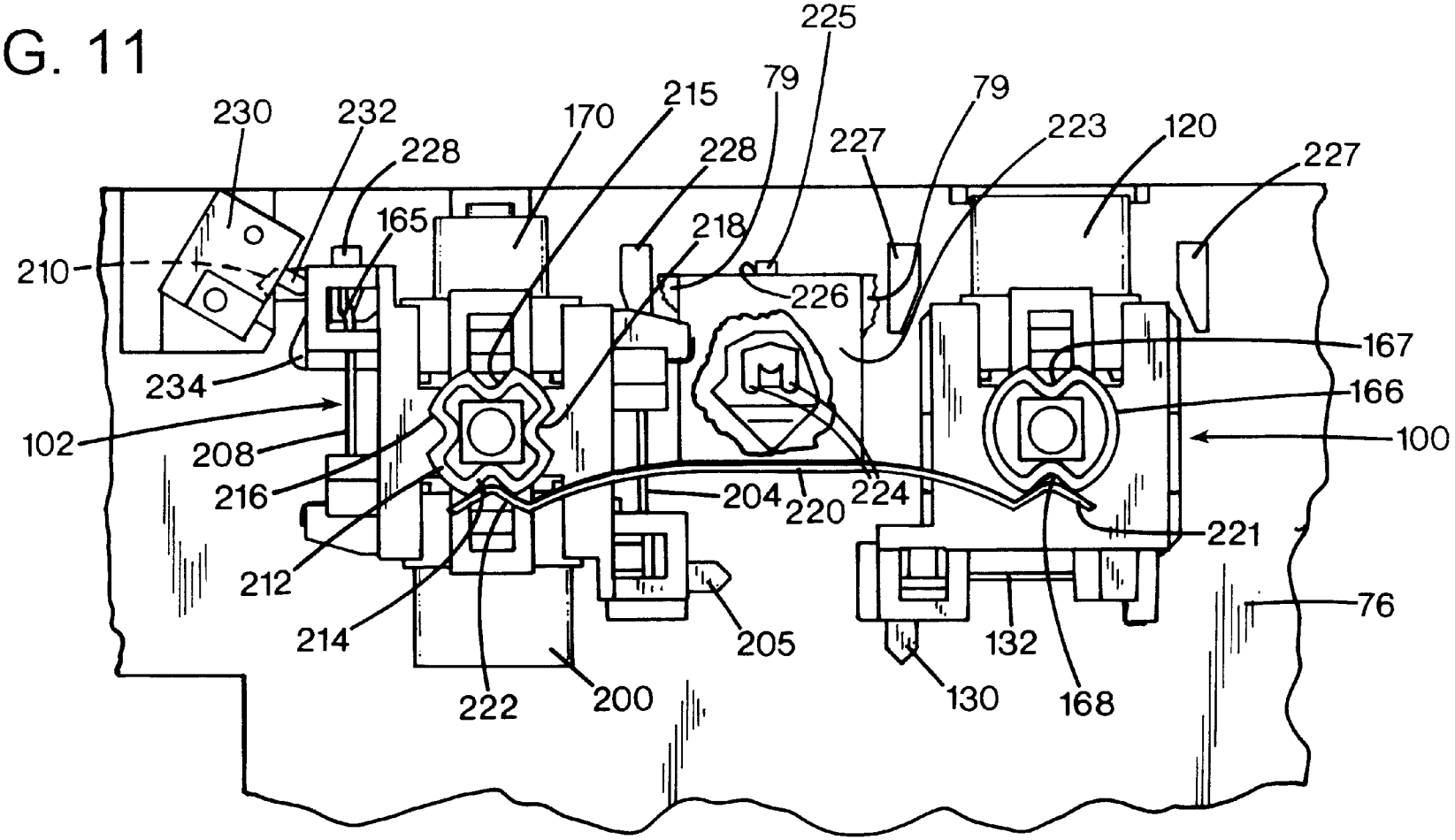
FIG. 11 is a partially fragmented, rear elevational view of the service station of FIG. 2, illustrating ore manner of spring biasing servicing tools of the full color tumbler assembly and of the combination tumbler assembly into contact with the cartridge printheads when installed in the carriage.

A final component of the combination tumbler assembly 102 is a hub 212 extending outwardly from the rear wall of the tumbler body 105. The hub 212 includes a series of support notches, which are best shown in FIG. 11 as including a black cap support notch 214, an imaging cap support notch 215 opposite notch 214, an imaging wiper support notch 216, and a black wiper support notch 218. The hub 166 of the color tumbler assembly 100 and hub 212 of the combination tumbler assembly 202 are each floating hubs, supported from below by a leaf spring locator element 220, illustrated with an exaggerated thickness in FIG. 11.

As shown in FIG. 11, the locator spring 220 has a color knuckle 221, which rides around the periphery of the color tumbler shaft 166. The knuckle 221 resides within the cap notch 168: when the color cap 120 is in a position for sealing the color printhead 65, and knuckle 221 resides within notch 167 when the color wiper 130 wipes printhead 65. Opposite the color knuckle 221, the locator spring 220 has another knuckle 222 that rides around the periphery of the combination tumbler shaft 212. This combination shaft knuckle 222 selectively engages: (1) notch 214 to facilitate capping of the black printhead 64 with cap 170, (2) notch 216 to facilitate wiping of the imaging printhead 66 with wiper 205, (3) notch 215 to facilitate capping of the imaging printhead 66 with cap 200, and (4) notch 218 to facilitate wiping of the black printhead 64 with the black wiper 210.

The leaf spring locator element 220 is preferably a unitary element of a spring steel material that includes a U-shaped mounting portion 223 with an up-side-down U-shaped hook that sits over the upper edge of the interior wall 79. When installed, the knuckles 221 and 222 rest adjacent the rear surface of wall 79. The portion of the U-shaped mount 223 which rests against the front surface of wall 79 has a pair of upwardly and inwardly projecting barbs 224 which dig into this front surface of wall 79 to secure the locator element 220 on the wall. The wall 79 has an upwardly projecting post 225 which is sized to fit into a hole 226 that extends through the top of the U-shaped mount 223. Engagement of the post 225 with hole 226 holds the locator element 220 in a desired lateral position along the wall 79. The leaf spring locator 220 advantageously assures that the color tumbler 100 moves vertically between a pair of guide shoulders 227 extending outwardly from the rear surface of the immediate wall 76. Similarly, the locator spring 220 also assures that the combination tumbler 202 slides vertically between a pair of guide shoulders 228 extending outwardly from the rear surface of the immediate wall 76. The guide members 227, 228 advantageously insure that the servicing appliances or tools supported by tumblers 100, 102 are aligned with their associated printheads when elevated into servicing positions, in a manner described further below with respect to FIGS. 12–18.

To provide positional feedback information to the printer controller 45 regarding the locations of the various service station components, such as after power to the printer 30 has been turned off or interrupted, the service station 50 includes a positional feedback switch 230 which is mounted to the rear surface of the interior wall 76. The feedback switch 230 may be a micro switch, having a plunger 232 which is depressed by an actuator finger or projection 234 extending from a portion of the combination tumbler body 105. Thus, upon activation, the motor 74 may be operated to rotate the service station tumblers 100, 102 until the actuator finger 234 depresses the plunger 232 of the microswitch 230, upon which the microswitch 230 issues a positional feedback signal to the controller 45. Thus, even if power is interrupted during a servicing cycle, the printer 30 has the ability to determine the location and position of the components of service station 50 and to reinitiate a servicing sequence.

Figure 12:
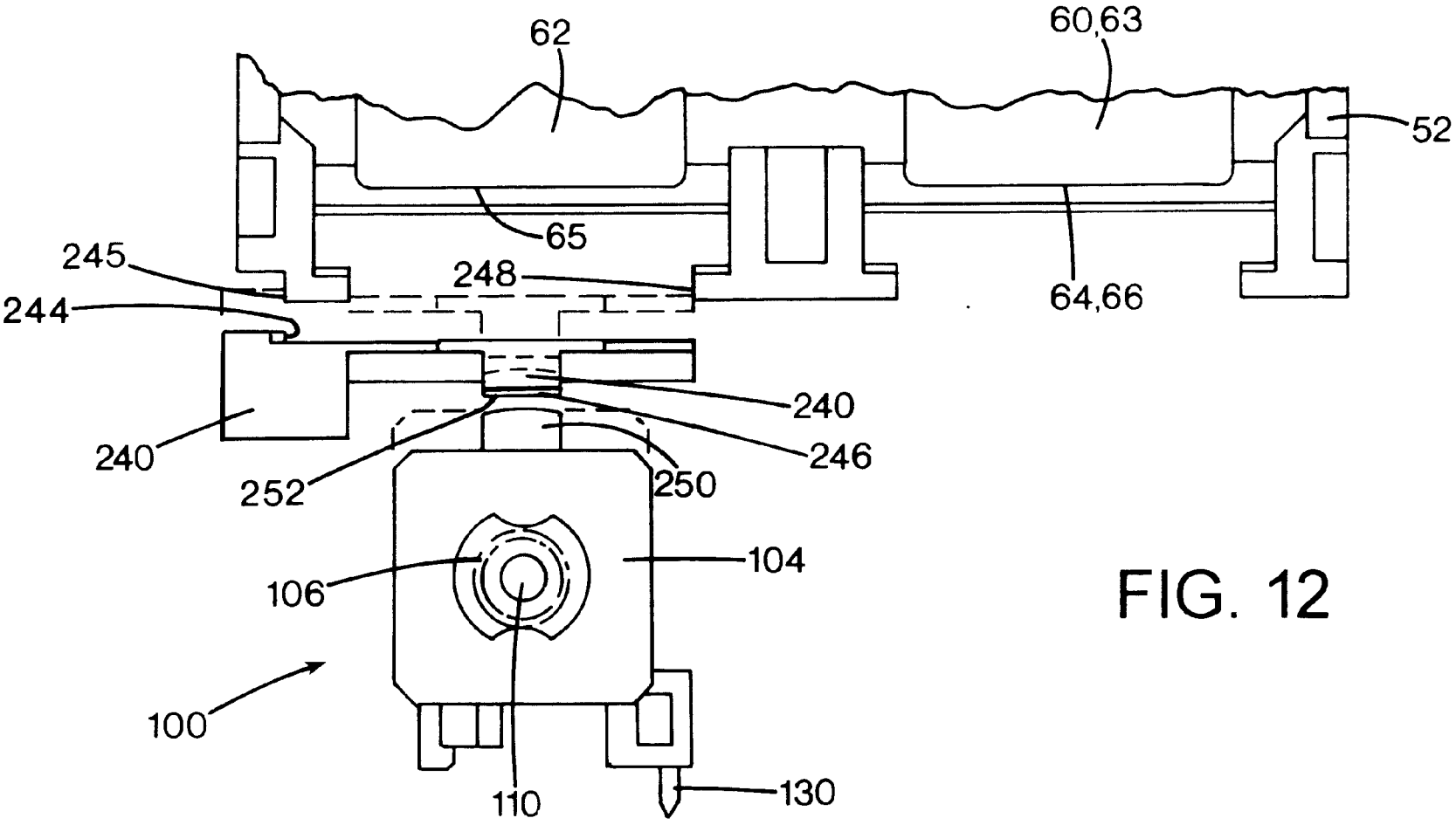
FIG. 12 is a front elevational view of one form of a carriage lock of the present invention, showing a locking position in dashed lines.

FIG. 12 shows a carriage locking mechanism 240, which is part of the service station 50. Here, the carriage lock 240 is secured for vertical motion against the rear surface of the interior wall 76 between a pair of guide members 242 abutting opposing sides of a lock guide slot through wall 76, shown in FIGS. 2 and 3. During transportation, as well as during periods of printer activity, when the printer may be bumped or jostled, it is particularly important that the printhead carriage 52 be locked with respect to the service station 50, to assure that the printheads 64–66 remain sealed by their respective caps 120, and 170 or 200, depending upon whether the black cartridge 60 or the imaging cartridge 63 is installed in the carriage 52. While the combination tumbler 102 has the job of activating the positional control switch 230, the color tumbler 100 provides the function of locking the carriage 52 with respect to the service station frame 70, which is convenient since whenever the full color printhead 65 is capped the carriage 52 should be locked regardless of which of the combination tumbler caps 170 or 200 is currently in use for sealing. As shown in FIG. 12, the carriage lock 240 has a locking surface 244 which is configured to engage an abutment surface 245 defined by the carriage 52. The lock 240 has a biasing tongue member 246 that extends forwardly through the lock guide slot of wall 76 between guides 242 to be engaged and biased downwardly by a lock biasing member (FIG. 2), such as a leaf spring finger 248 molded to extend from a portion of the front wall 72, as shown in FIGS. 2 and 3. To move the locking mechanism 240 into position, the color tumbler body 104 includes a lock actuator member 250, which is moved upwardly during the capping process, as described further below, and into contact with a lock activator member 252 along an undersurface of the lock 240. FIG. 12 shows the position of the carriage 52, locking member 240, and color tumbler 104 prior to locking in solid lines, and when locked in dashed lines, with the lock surfaces 244, 245 engaging the carriage 252 at locations 246, 248, respectively. For simplicity, the color cap 120, as well as the combination tumbler assembly 102, have been omitted from the view of FIG. 12.

Figure 13:
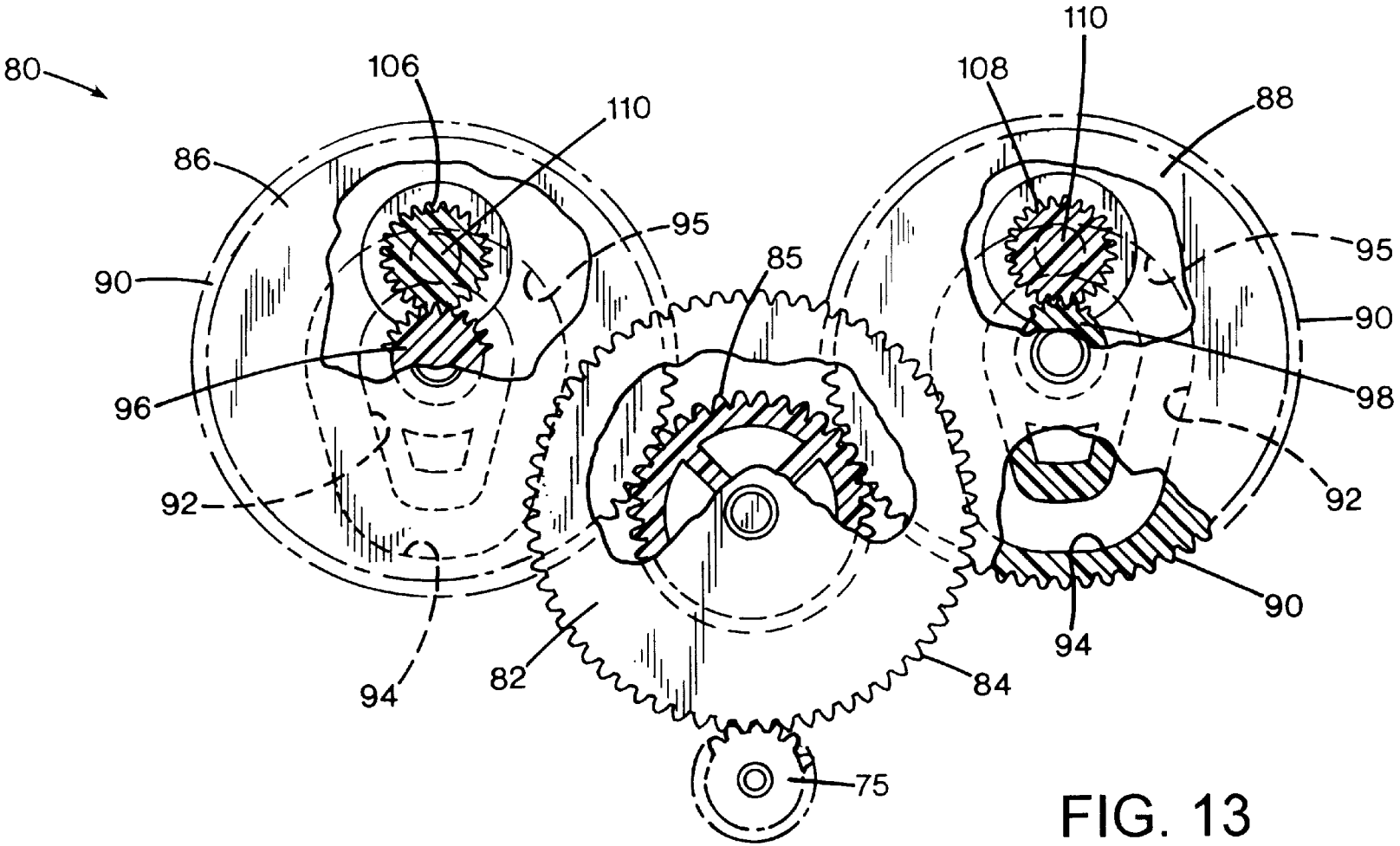

FIGS. 13–20 illustrate the operation of the drive gear set 80 in positioning the various service tools on tumblers 100, 102 in servicing contact with the printheads 64–66. In FIG. 13, the servicing components of tumblers 100, 102 are lowered into a retracted position as the cam follower spindles 110 move through the rotation portion 95 of cam track 92. In FIG. 13, the drive gear set 80 is rotating both of the tumbler assemblies 100, 102 via contact of their respective bull gears 106, 108 with the pinion gears 96, 98 of the color and combination drive gears 86, 88, so the color tumbler 100 rotate 180° (a half turn), whereas the combination tumbler 102 rotates only 90° (one quarter turn). This 180°/90° degree rotation of tumblers 100, 102 allows the full color tumbler 100 to transition between the cap 120 and the wiper 130 for the color printhead 65, while the combination tumbler 102 transitions only 90 degrees, between the black cap 170 and the black wiper 210 to service the black head printhead 64 when the black cartridge 60 is installed in carriage 52. Similarly, the 180°/90° tooth orientation of gears 96, 98 allows the color tumbler to transition between the color cap 120 and the color wiper 130 while the combination tumbler 102 transitions between the imaging cap 200 and the imaging wiper 205 to service the imaging printhead 66 when the imaging cartridge 63 is installed in carriage 52. Before the advent of service station 50, no system was known to be capable of providing separate capping and servicing functions for two interchangeable printheads 64, 66 for the black and imaging pens 60, 63, as well as to provide continuous servicing of a third type of printhead, here, the full color printhead 65 of pen 62.

FIGS. 14–20 illustrate the transitions of the various servicing components, with the rotation of the gears 75, 82, 86, 88, 106 and 108 being illustrated by the curved arrows shown therein. In FIG. 14, the color wiper 130 and the black wiper 210 are shown elevated to their respective wiping positions for servicing the color and black printheads 65, 64, with the cam follower spindles 110 of both tumblers 100, 102 resting at the crest of the elevating portion 94 of cam track 92. Movement of the printhead carriage 52 over the wipers 130, 210 serves to provide the relative motion required to complete a wiping stroke of a series of wiping strokes. In FIG. 15, the motor 75 has driven the gear assembly 80 to retract the wipers 130, 210 from their servicing positions, as the spindles 110 move through the cam track 92 away from the elevating portion 94 and toward the rotating portion 95.

In FIGS. 16 and 17, the spindles 110 are traversing through the cam track rotating portions 95. In FIG. 16, the color tumbler bull gear 106 is already being driven by the 1800 arc of teeth on the pinion gear 96. FIG. 17 shows the completion of a one quarter turn of the combination tumbler assembly 102 after engagement of the combination tumbler bull gear 108 with the 90° arc of teeth on pinion gear 98, leaving the black cap 170 indexed into a retracted, ready to service position. FIG. 17 shows the color tumbler 100 still being driven by the 180° arc of teeth on the pinion gear 96, with about another 45° of rotation of the color drive gear 86 being required to bring the color cap 120 into a retracted, ready to service position. FIG. 18 shows further rotation of the gear set 80 which has elevated the color and black caps 120 and 170 into their servicing positions to seal the color and black printheads 65, 66. While the black pen 60 is installed in carriage 52, the service station transitions between the wiping position of FIG. 14 and the capping position of FIG. 18, with the transition from capping into wiping preferably being most expeditiously accomplished by reversing the direction of rotation of the gear set 80 from that shown in FIGS. 14–18.

Figure 20:
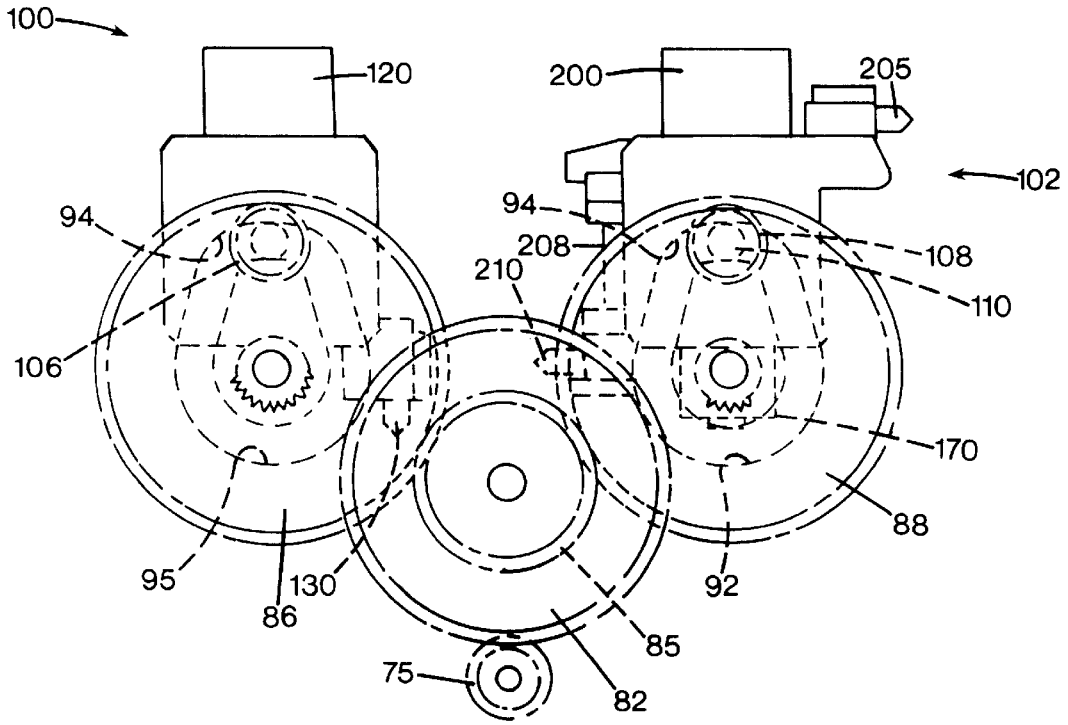

FIGS. 19 and 20 show the wiping and capping positions of service station 50 when the imaging cartridge 63 has been installed in carriage 52, in place of the black cartridge 60. The combination tumbler assembly 102 may be transitioned to the wiping position of FIG. 19 by continuing the direction of rotation shown in FIG. 18, to elevate the color wiper 130 and the imaging wiper 205 to their servicing positions. The combination tumbler 102 may be transitioned to the capping position of FIG. 20 by starting with the orientation of FIG. 14, and reversing the direction of rotation shown, to elevate the color cap 120 and the imaging cap 200 to their servicing positions. Transition from the wiping position of FIG. 19 to the capping position of FIG. 20 may be most expeditiously accomplished by rotating the gear set 80 as shown by the arrows in FIG. 19, with reverse rotation being used to return from capping to wiping. It is apparent that the manner of retracting and raising the wipers 130, 205 and caps 120, 200 is accomplished through travel of the spindles 110 in the cam track 92, as shown for the color pen and black pen servicing components in FIGS. 14–18, as well as the 180°/90° rotation of the tumbler bodies 104, 105 by gears 96 and 98. Preferably, the wipers are raised to first contact the pen orifice plates between the nozzles and any encapsulant beads adjacent the linear nozzle arrays after which the wiping stroke proceeds by moving the carriage 52. This system avoids dragging any contaminates, ink residue or debris collected at the encapsulant beads back over the nozzles.

Conclusion

Thus, a method of servicing three inkjet cartridges, each of which has different servicing needs, is provided for an inkjet printing mechanism that receives one of the cartridges and interchangeably receives one of the other two cartridges, such as a black ink cartridge or a multi-color ink cartridge. A service station for this purpose, as well as an inkjet printing mechanism incorporating this service station are also provided. While the illustrated embodiment of printer 30 envisioned the use of dye-based inks in all three inkjet cartridges 60, 62 and 63, it is apparent that these cartridges may also carry different types of ink formulations, such as dye-based color and imaging inks in pens 60 and 63, and a pigment-based ink in the black pen 60. Indeed, by providing separate servicing components for each pen 60, 62 and 63, enhanced printer versatility is obtained, allowing the printer 30 to be used with other new ink formulations which may be developed in the future. Thus, this servicing isolation scheme provides the printer 30 with greater flexibility in ink selection, while avoiding cross contamination of inks from different interchangeable pens, here, illustrated using the monochrome black pen 60 and the imaging pen 63. With ink cross contamination avoided, crisp, clear images may be printed using either the black pen 60 or the imaging pen 63, in combination with the full color pen 62.

We claim:

1. A service station for servicing the printheads of interchangeable first and second inkjet cartridges when installed with a third inkjet cartridge in a dual-cartridge carriage of an inkjet printing mechanism, comprising:

a frame;

a combination tumbler assembly supporting first and second sets of servicing tools for servicing the respective first and second inkjet cartridges;

a singular tumbler assembly supporting a third set of servicing tools for servicing the third inkjet cartridge; and an indexing mechanism that pivotally and translationally couples the combination tumbler assembly and the singular tumbler assembly to the frame to index the third set of servicing tools into servicing positions to service the third cartridge printhead, and to either (1) index the first set of servicing tools into servicing positions to service the first cartridge printhead when installed in the carriage, or (2) index the second set of servicing tools into servicing positions to service the second cartridge printhead when installed in the carriage.

2. A service station according to claim 1 wherein the indexing mechanism operates to pivot:

the singular tumbler assembly through a first angle of rotation to selectively position two servicing tools of the third set into servicing positions; and the combination tumbler assembly through a second angle of rotation different from than the first angle of rotation to selectively position two servicing tools of the first set into servicing positions when the first cartridge is installed in the carriage, and through a third angle of rotation different from than the first angle of rotation to selectively position two servicing tools of the second set into servicing positions when the second cartridge is installed in the carriage.

3. A service station according to claim 2 wherein:

the first angle of rotation of the singular tumbler assembly comprises a half rotation; and the second and third angles of rotation of the combination tumbler assembly each comprise a quarter rotation.

4. A service station according to claim 1 wherein:

the singular and combination tumbler assemblies each have a cam follower; and the indexing mechanism comprises a gear assembly having a singular gear for driving the singular tumbler assembly and a combination gear for driving the combination tumbler assembly, with the singular and combination gears each having a cam track that receives the cam follower of the respective singular and combination tumbler assemblies for movement into servicing positions.

5. A service station according to claim 4 wherein:

the cam followers of the singular and combination tumbler assemblies each comprise a spindle member;

the singular and combination tumbler assemblies each have a bull gear adjacent said spindle member;

the cam tracks of the singular and combination gears each have a rotating portion;

the singular gear has a tool indexing gear that engages the bull gear of the singular tumbler assembly when the spindle member thereof is in the rotating portion of the singular gear cam track to rotate the singular tumbler assembly a half turn to selectively index two servicing tools of the third set into pre-servicing positions; and the combination gear has a tool indexing gear that engages the bull gear of the combination tumbler assembly when the spindle member thereof is in the rotating portion of the combination gear cam track to rotate the combination tumbler assembly a quarter turn lo selectively index two servicing tools of the third set into pre-servicing positions when the first cartridge is installed in the carriage, and to rotate the combination tumbler assembly a quarter turn to selectively index two servicing tools of the second set into pre-servicing positions when the second cartridge is installed in the carriage.

6. A service station according to claim 5 wherein the cam tracks of the singular and combination gears each have an elevating portion for moving the tools of the respective singular and combination tumbler assemblies into servicing positions, and thereafter, for moving said tools away from said servicing positions.

7. A service station according to claim 1 wherein:

the first, second and third sets of servicing tools each comprise a wiper and a cap;

the wipers of the first and second sets of servicing tools are each supported by the combination tumbler assembly with a biasing member that resiliently pushes the associated wiper into contact with the printhead of the associated cartridge when installed in the carriage; and the wiper of the third set of servicing tools is supported by the singular tumbler assembly with a biasing member that resiliently pushes the associated wiper into contact with the printhead of the third cartridge.

8. A service station according to claim 7 wherein said biasing members that push the associated wipers of the first, second and third sets of servicing tools each comprise a leaf spring member capable of translational and torsional flexure.

9. A service station according to claim 1 wherein the combination tumbler assembly comprises:

a restraining sleeve that defines a hollow interior which terminates in opposing first and second ends;

a first cap restrained within the hollow interior of the sleeve and sized to seal the first cartridge;

a second cap restrained within the hollow interior of the sleeve and sized to seal the second cartridge; and a biasing member received within the hollow interior of the sleeve to bias the first and second caps toward the respective first and second ends of the sleeve.

10. A method of servicing the printheads of interchangeable first and second inkjet cartridges when installed with a third inkjet cartridge in a dual-cartridge carriage of an inkjet printing mechanism, comprising the steps of:

providing a combination tumbler assembly supporting first and second sets of servicing tools, and a singular tumbler assembly supporting a third set of servicing tools;

indexing a selected tool of the third set of servicing tools into a pre-servicing position by moving the singular tumbler assembly, and (1) indexing a selected tool of the first set of servicing tools into a pre-servicing position by moving the combination tumbler assembly when the first cartridge printhead is installed in the carriage, or (2) indexing a selected tool of the second set of servicing tools into a pre-servicing position by moving the combination tumbler assembly when the second cartridge printhead is installed in the carriage; and moving said selected servicing tools into servicing positions and thereafter, servicing the printheads with said selected tools.

11. A method according to claim 10 wherein:

the indexing step comprises the step of rotating the singular and combination tumbler assemblies; and the moving step comprises the step of raising said selected servicing tools into servicing positions.

12. A method according to claim 11 wherein the rotating step comprises the steps of:

rotating the singular tumbler assembly a half turn to index between two servicing tools of the third set;

rotating the combination tumbler assembly a quarter turn to index between two servicing tools of the first set when the first cartridge is installed in the carriage; and rotating the combination tumbler assembly a quarter turn to index between two servicing tools of the second set when the second cartridge is installed in the carriage.

13. A method according to claim 10 wherein:

the providing step comprises providing a wiper for each of the first, second and third sets of servicing tools; and the method further includes the steps of biasing the wiper of the third set of servicing tools away from the singular tumbler assembly, and biasing each wiper of the first and second sets of servicing tools away from the combination tumbler assembly.

14. A method according to claim 13 wherein:

the providing step comprises providing a cap for each of the first, second and third sets of servicing tools, providing the combination tumbler assembly with a restraining sleeve member, and providing a single biasing member;

the method further includes the step of biasing the cap of the third set of servicing tools away from the singular tumbler assembly; and the method further includes the steps restraining the cap of the first and second sets of servicing tools within the restraining sleeve member, and biasing each restrained cap away from the other restrained cap with said single biasing member.

15. An inkjet printing mechanism for printing an image, comprising:

at least two inkjet cartridges comprising:

(1) either one of:

(a) a first cartridge, or (b) a second cartridge, and (2) a third cartridge;

a dual-cartridge carriage that receives the third cartridge, and that interchangeably receives the first cartridge or the second cartridge;

a service station comprising:

a frame;

a combination tumbler assembly supporting first and second sets of servicing tools for servicing the respective first and second inkjet cartridges;

a singular tumbler assembly supporting a third set of servicing tools for servicing the third inkjet cartridge; and an indexing mechanism that pivotally and translationally couples the combination tumbler assembly and the singular tumbler assembly to the frame to index the third set of servicing tools into servicing positions to service the third cartridge printhead, and to either (1) index the first set of servicing tools into servicing positions to service the first cartridge printhead when installed in the carriage, or (2) index the second set of servicing tools into servicing positions to service the second cartridge printhead when installed in the carriage.

16. An inkjet printing mechanism according to claim 15 wherein the indexing mechanism operates to pivot:

the singular tumbler assembly through a half rotation to selectively position two servicing tools of the third set into servicing positions; and the combination tumbler assembly through a quarter rotation to selectively position two servicing tools of the first set into servicing positions when the first cartridge is installed in the carriage, and through a quarter rotation to selectively position two servicing tools of the second set into servicing positions when the second cartridge is installed in the carriage.

17. An inkjet printing mechanism according to claim 15 wherein:

the first, second and third sets of servicing tools each include a wiper;

the wipers of the first and second sets of servicing tools are each supported by the combination tumbler assembly with a biasing member that resiliently pushes the associated wiper into contact with the printhead of the associated cartridge when installed in the carriage;

the wiper of the third set of servicing tools is supported by the singular tumbler assembly with a biasing member that resiliently pushes the associated wiper into contact with the printhead of the third cartridge; and wherein said biasing members each comprise a leaf spring member capable of translational and torsional flexure.

* * * * *

UNITED STATES PATENT AND TRADEMARK OFFICE

CERTIFICATE OF CORRECTION

PATENT NO. : 6,000,779
DATED : December 14, 1999
INVENTOR(S) : Ng et al.

It is certified that error appears in the above-identified patent and that said Letters Patent is hereby corrected as shown below:

Column 1,
Line 47, delete "(each" and insert therefor -- each --.

Column 2,
Line 44, delete "portrait" and insert therefor -- portraits --.
Line 48, delete "processes" and insert therefor -- process --.

Column 3,
Line 6, delete "Elewlett-Packard" and insert therefor -- Hewlett Packard --.
Line 21, delete "back" and insert therefor -- black --.
Line 24, delete dye.-based" and insert therefor -- dye-based --.

Column 4,
Line 1, after "In" insert -- the --.
Line 21, delete "a" and insert therefor -- an --.
Line 67, delete "ore" and insert therefor -- one --.

Column 6,
Line 26, delete "print 2: one" and insert therefor -- printzone --.
Line 65, after "types" delete ",".

Column 9,
Line 9, delete "lo" and insert therefor -- to --.

Column 11,
Line 25, delete "chamer" and insert therefor -- chamber --.
Line 35, delete "an" and insert therefor -- a --.

Column 13,
Line 17, delete "slot,;" and insert therefor -- slots --.
Line 27, after "fit" delete "of".
Line 41, after "this" delete ";".

Column 14,
Line 1, delete "ore" and insert therefor -- one --.

UNITED STATES PATENT AND TRADEMARK OFFICE

CERTIFICATE OF CORRECTION

PATENT NO. : 6,000,779
DATED : December 14, 1999
INVENTOR(S) : Ng et al.

It is certified that error appears in the above-identified patent and that said Letters Patent is hereby corrected as shown below:

Column 15,
Line 13, after "168" delete ":".

Column 16,
Line 18, after "capped" insert -- , --.

Column 17,
Line 22, delete "1800" and insert therefor -- 180° --.
Line 37, delete "into" and insert therefor -- to --.

Abstract,
Line 17, after "tools" delete ";".

Claims,
Column 18,
Line 55, after "different" delete "from".
Line 59, after "different" delete "from".

Column 19,
Line 30, delete "lo" and insert therefor -- to --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*